US010768566B2

(12) United States Patent
Maeda et al.

(10) Patent No.: US 10,768,566 B2
(45) Date of Patent: Sep. 8, 2020

(54) IMAGE FORMING APPARATUS FOR GENERATING DRIVE DATA BY PERFORMING A MAGNIFICATION CORRECTION ON IMAGE DATA

(71) Applicant: CANON KABUSHIKI KAISHA, Tokyo (JP)

(72) Inventors: Yuichiro Maeda, Kashiwa (JP); Kazuhiro Akiba, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/611,661

(22) Filed: Jun. 1, 2017

(65) Prior Publication Data

US 2017/0357201 A1 Dec. 14, 2017

(30) Foreign Application Priority Data

Jun. 9, 2016 (JP) ..... 2016-115453

(51) Int. Cl.
*G03G 15/00* (2006.01)
*G03G 15/041* (2006.01)
*G03G 15/01* (2006.01)

(52) U.S. Cl.
CPC ..... *G03G 15/5054* (2013.01); *G03G 15/011* (2013.01); *G03G 15/0189* (2013.01); *G03G 15/0415* (2013.01)

(58) Field of Classification Search
CPC ..... G03G 15/5095
See application file for complete search history.

(56) References Cited

U.S. PATENT DOCUMENTS

2005/0206744 A1* 9/2005 Ohkawara ..... H04N 1/053 348/222.1

FOREIGN PATENT DOCUMENTS

JP 2005-096351 A 4/2005
JP 2013-240994 A 12/2013

* cited by examiner

*Primary Examiner* — Fan Zhang
(74) *Attorney, Agent, or Firm* — Canon U.S.A., INC. IP Division

(57) ABSTRACT

If a timing of outputting magnification correction data for first image data to form first electrostatic latent image for an (n+1)th print medium overlaps a timing of outputting magnification correction data for second image data to form an electrostatic latent image for an nth print medium having a size smaller than the (n+1)th print medium in a conveyance direction of the print medium, a CPU outputs the magnification correction data for the second image data to form the second electrostatic latent image for the nth print medium before the magnification correction data for the first image data to form the first electrostatic latent image for the (n+1)th print medium is output and outputs the magnification correction data for the (n+1)th print medium after a magnification correction process performed by a second data processing unit based on the magnification correction data for the nth print medium is completed.

6 Claims, 13 Drawing Sheets

FIG. 10
PRIOR ART

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 | 0 | 0 |
| 0001 | 0 | 0 | 0 | 0 | 0 | 0 | 0 | 0 | 0 | 0 | 0 | 0 | 0 | 0 | 1 | 1 |
| 0010 | 0 | 0 | 0 | 0 | 0 | 0 | 0 | 0 | 0 | 0 | 0 | 0 | 0 | 1 | 1 | 1 |
| 0011 | 0 | 0 | 0 | 0 | 0 | 0 | 0 | 0 | 0 | 0 | 0 | 0 | 1 | 1 | 1 | 1 |
| 0101 | 0 | 0 | 0 | 0 | 0 | 0 | 0 | 0 | 0 | 0 | 0 | 1 | 1 | 1 | 1 | 1 |
| 0110 | 0 | 0 | 0 | 0 | 0 | 0 | 0 | 0 | 0 | 0 | 1 | 1 | 1 | 1 | 1 | 1 |
| 0111 | 0 | 0 | 0 | 0 | 0 | 0 | 0 | 0 | 0 | 1 | 1 | 1 | 1 | 1 | 1 | 1 |
| 1000 | 0 | 0 | 0 | 0 | 0 | 0 | 0 | 0 | 1 | 1 | 1 | 1 | 1 | 1 | 1 | 1 |
| 1001 | 0 | 0 | 0 | 0 | 0 | 0 | 0 | 1 | 1 | 1 | 1 | 1 | 1 | 1 | 1 | 1 |
| 1010 | 0 | 0 | 0 | 0 | 0 | 0 | 1 | 1 | 1 | 1 | 1 | 1 | 1 | 1 | 1 | 1 |
| 1011 | 0 | 0 | 0 | 0 | 0 | 1 | 1 | 1 | 1 | 1 | 1 | 1 | 1 | 1 | 1 | 1 |
| 1100 | 0 | 0 | 0 | 0 | 1 | 1 | 1 | 1 | 1 | 1 | 1 | 1 | 1 | 1 | 1 | 1 |
| 1101 | 0 | 0 | 0 | 1 | 1 | 1 | 1 | 1 | 1 | 1 | 1 | 1 | 1 | 1 | 1 | 1 |
| 1110 | 0 | 0 | 1 | 1 | 1 | 1 | 1 | 1 | 1 | 1 | 1 | 1 | 1 | 1 | 1 | 1 |
| 1111 | 0 | 1 | 1 | 1 | 1 | 1 | 1 | 1 | 1 | 1 | 1 | 1 | 1 | 1 | 1 | 1 |

IMAGE FORMING APPARATUS FOR GENERATING DRIVE DATA BY PERFORMING A MAGNIFICATION CORRECTION ON IMAGE DATA

BACKGROUND OF THE INVENTION

Field of the Invention

The aspect of the embodiments relates to an image forming apparatus.

Description of the Related Art

As an image printing technology for use in image forming apparatuses (e.g., a copying machine), an electrophotographic technology has been developed. Electrophotographic image forming apparatuses form a latent image on a photoconductor by emitting a light beam to the photoconductor based on image data input from a document reader or an external device, such as a computer. The latent image is developed with a coloring material (toner). An example of a color image forming apparatus is an image forming apparatus including a plurality of photoconductors for developing yellow, magenta, cyan, and black toner images and a plurality of light sources each provided for one of the photoconductors and emitting a light beam. FIG. 7A illustrates the control blocks of the color image forming apparatus.

Image forming apparatuses perform correction in accordance with the characteristics of a laser scanner. An example of such correction is partial magnification correction described in Japanese Patent Laid-Open Nos. 2005-096351 and 2013-240994, which is magnification correction to be applied to each of a plurality of sub-areas obtained by dividing the image formation area in the main scanning direction.

In recent years, to meet the demands for higher image quality, the image formation area has been finely divided in the main scanning direction (for example, divided into 32). In addition, in many cases, a plurality of light beams are provided to improve the throughput of the image forming apparatus, and the output from a PWM output unit 5216 is transmitted to an optical scanning device 5104 for each of the light beams. Thus, the cost increases with increasing number of required signal lines. Accordingly, as illustrated in FIG. 7B, the image processing unit is divided into a first image processing unit 6200 and a second image processing unit 6250 so as to reduce the number of signal lines.

In the image forming apparatus in a tandem configuration illustrated in FIG. 8A, to form a color image, toner images of respective colors formed on photoconductive drums 7001 is transferred to 7004 so that the images overlap at the same position on a transfer belt 7009. Therefore, as illustrated in FIG. 8B, the color image forming apparatus in a tandem configuration forms the latent images of the respective colors by delaying the start time of formation from a reference timing signal 8000 by time periods Td1, Td2, and Td3, respectively.

Image forming apparatuses developed in recent years can insert a separator sheet between each printout during continuous printing. If the sizes of the print medium of the printout and the separator sheet differ from each other, the CPU is to send control data again and perform image formation in accordance with the size of the print medium after switching. The control data is transmitted in a period during which no image data is transmitted from the first image processing unit 6200 to the second image processing unit 6250. As illustrated in FIG. 7B, the control data is communicated (transmitted) via a common signal line 600 connected to a communication unit 6105 and a communication unit 6252.

However, as illustrated in FIG. 9B, when a single separator sheet having a size that differs from the size of the print media is inserted between the print media during continuous printing, the following situation arises. For example, even when the transmission start timing of M color control data is reached (9502*c*), Y control data is still being transmitted (9501*c*). For this reason, transmission of the M color control data is not performed in the communication period-β, and the transmission starts after a communication period α has elapsed. In contrast, since transmission of M color image data is started based on a reference timing signal, transmission of the M color image data is started before the transmission of the M control data is completed (9502*a*). As a result, an M color image cannot be properly formed and, thus, image defects may occur. The same applies to C and M colors.

To avoid such a situation, a method for increasing the communication speed of serial communication or a method for expanding the interval between the trailing edge of the previous image and the leading edge of the image can be employed. Alternatively, for example, a method for increasing a rotational speed v of the photoconductive drum while keeping the throughput constant or a method for communicating the Y color control data after transmission of the K color control data can be employed. However, these methods increase the cost or decrease the throughput.

SUMMARY OF THE INVENTION

According to an aspect of the embodiments, an image forming apparatus includes a first toner image forming unit including a first photoconductor rotatingly driven, a first exposure unit configured to expose the first photoconductor, a first drive unit configured to drive the first exposure unit based on first drive data, and a first development unit configured to develop, with toner of a first color, a first electrostatic latent image formed on the first photoconductor through exposure in the first exposure unit, a second toner image forming unit including a second photoconductor rotatingly driven, a second exposure unit configured to expose the second photoconductor, a second drive unit configured to drive the second exposure unit based on second drive data, and a second development unit configured to develop, with toner of a second color, a second electrostatic latent image formed on the second photoconductor through exposure in the second exposure unit, and a transfer unit formed as an endless transfer belt rotatingly driven, where the transfer unit is configured to transfer the toner image on the first photoconductor and the toner image on the second photoconductor to a print medium via the transfer member. A transfer position of the toner image transferred from the first photoconductor to the transfer member is located upstream of a transfer position of the toner image transferred from the second photoconductor to the transfer member in a rotational direction of the transfer member, and a formation start timing of the second electrostatic latent image is delayed behind a formation start timing of the first electrostatic latent image on one print medium based on a delay amount in accordance with a distance between the transfer positions. The image forming apparatus further includes a data generation unit configured to generate first image data for the first color and second image data for the second color from input image data, a data processing unit configured to generate the first drive data obtained by performing a magnification correction process on the first image data and the second drive data obtained by performing a magnification correction process on the second image data based on set magnification correction data, and a controller configured to switch setting of the magnification correction data in accordance with a size of the print medium, where the controller switches the magnification correction data set in the data processing unit by outputting, to the data processing unit via a common signal line, the magnification correction data for the first image data and the magnification correction data for the second image data at different timings based on the delay amount corresponding to the distance between the transfer positions. If a timing of outputting the magnification correction data for the first image data to form the first electrostatic latent image for an (n+1)th print medium overlaps a timing of outputting the magnification correction data for the second image data to form an electrostatic latent image for an nth print medium having a size smaller than the (n+1)th print medium in a conveyance direction of the print medium, the controller outputs the magnification correction data for the second image data to form the second electrostatic latent image for the nth print medium before the magnification correction data for the first image data to form the first electrostatic latent image for the (n+1)th print medium is output, and the controller outputs the magnification correction data for the (n+1)th print medium after a magnification correction process performed by the data processing unit based on the magnification correction data for the nth print medium is completed.

According to another aspect of the embodiments, an image forming apparatus includes a first toner image forming unit including a first photoconductor rotatingly driven, a first exposure unit configured to expose the first photoconductor, a first drive unit configured to drive the first exposure unit based on first drive data, and a first development unit configured to develop, with toner of a first color, a first electrostatic latent image formed on the first photoconductor through exposure in the first exposure unit, a second toner image forming unit including a second photoconductor rotatingly driven, a second exposure unit configured to expose the second photoconductor, a second drive unit configured to drive the second exposure unit based on second drive data, and a second development unit configured to develop, with toner of a second color, a second electrostatic latent image formed on the second photoconductor through exposure in the second exposure unit, and a transfer unit formed as a endless transfer belt rotatingly driven, where the transfer unit is configured to transfer the toner image on the first photoconductor and the toner image on the second photoconductor to a print medium via the transfer member. A transfer position of the toner image transferred from the first photoconductor to the transfer member is located upstream of a transfer position of the toner image transferred from the second photoconductor to the transfer member in a rotational direction of the transfer member, and a formation start timing of the second electrostatic latent image is delayed behind a formation start timing of the first electrostatic latent image on one print medium based on a delay amount in accordance with a distance between the transfer positions. The image forming apparatus further includes a data generation unit configured to generate first image data for the first color and second image data for the second color from input image data, a data processing unit configured to generate the first drive data obtained by performing a position correction process on the first image data to correct a position of a toner image relative to the print medium and the second drive data obtained by performing a position correction process on the second image data to correct a position of a toner image relative to the print medium based on set position correction data, and a controller configured to switch setting of the position correction data in accordance with a size of the print medium, where the controller switches the position correction data set in the data processing unit by outputting, to the data processing unit via a common signal line, the position correction data for the first image data and the position correction data for the second image data at different timings based on the delay amount corresponding to the distance between the transfer positions. If a timing of outputting the position correction data for the first image data to form the first electrostatic latent image for an (n+1)th print medium overlaps a timing of outputting the position correction data for the second image data to form an electrostatic latent image for an nth print medium having a size smaller than the (n+1)th print medium in a conveyance direction of the print medium, the controller outputs the position correction data for the second image data to form the second electrostatic latent image for the nth print medium before the position correction data for the first image data to form the first electrostatic latent image for the (n+1)th print medium is output, and the controller outputs the position correction data for the (n+1)th print medium after a position correction process performed by the data processing unit based on the position correction data for the nth print medium is completed.

Further features of the disclosure will become apparent from the following description of exemplary embodiments with reference to the attached drawings.

BRIEF DESCRIPTION OF THE DRAWINGS

FIG. 10 illustrates a conversion table according to the existing example.

DESCRIPTION OF THE EMBODIMENTS

Exemplary embodiments of the disclosure are described in detail below with reference to the accompanying drawings. As used herein, the direction in which the laser beam is scanned, namely, the direction of the rotation axis of a photoconductive drum is referred to as a "main scanning direction" or a "second direction", and a direction substantially perpendicular to the main scanning direction, namely, the direction of rotation of the photoconductive drum is referred to as a "sub-scanning direction" or a "first direction".

Configuration of Image Forming Apparatus

Figure 7A:
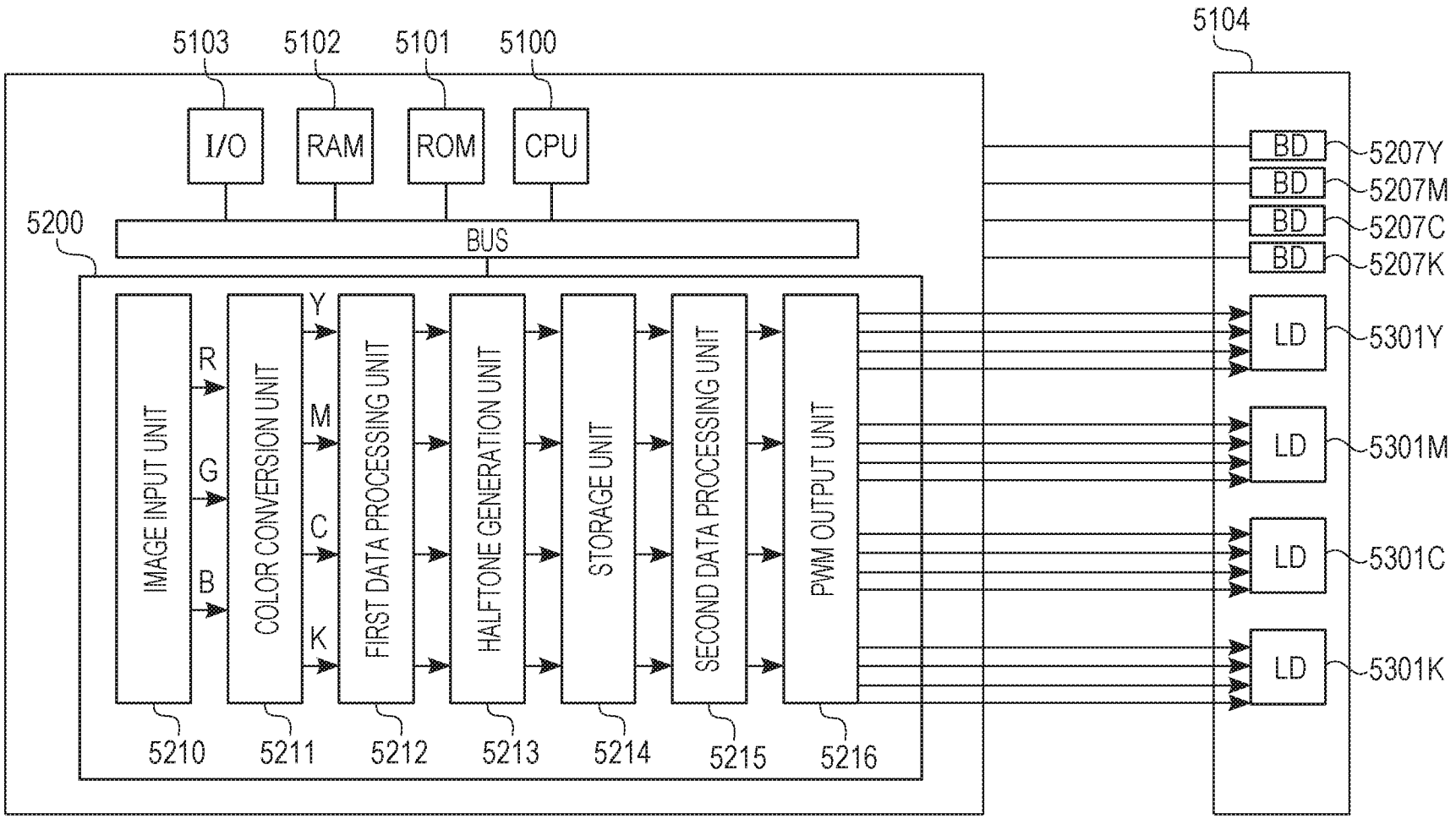
FIG. 7A PRIOR ART
FIGS. 7A and 7B are block diagrams of an image forming apparatus according to an existing example.

The transmission timing of each of the image data and the control data in the above-described existing image forming apparatus is described in detail below. FIG. 7A illustrates an example of control blocks for controlling a light beam based on image data input to the electrophotographic image forming apparatus. The image forming apparatus includes a CPU 5100 that performs overall control of the operation of the image forming apparatus, an image processing unit 5200 that performs a variety of image processing tasks on the input image data, and an optical scanning device 5104. For example, the image processing unit 5200 is a single integrated circuit (IC) chip. Because a circuit board and an optical scanning device 5104 (a laser scanner) that emits a light beam are disposed inside the image forming apparatus at different locations, the optical scanning device 5104 is disposed away from the CPU 5100 and the image processing unit 5200. During formation of an image, the CPU 5100 stores, in a register (not illustrated), control data used to control the image processing unit 5200, and the image processing unit 5200 operates based on the information stored in the register. In addition to data on the size of the image, the control data includes correction data for the laser scanner (described in more detail below) and time data used to transmit image data.

Arrows pointing from left to right in FIG. 7A indicate the sequence of the processes to be applied to image data input from an external device, such as a document reader or a computer. The image data input from an external device is configured for each of the colors, that is, red (R), green (G), and blue (B). The image data is input to an image input unit 5210. The image processing unit 5200 converts the image data of each of the colors (R, G, and B) input from the external device into image data corresponding to the colors of toner of the image forming apparatus by using the color conversion unit 5211. In this case, the colors of the toner of the image forming apparatus are, for example, yellow (Y), magenta (M), cyan (C) and black (K). The color conversion unit 5211 converts the image data of each of R, G, and B colors into image data of each of Y, M, C, and K colors. Image data for each of Y, M, C, and K colors is 8-bit density data. The image processing unit 5200 performs density correction processing on the image data of each of Y, M, C, and K colors. That is, the first data processing unit 5212 of the image processing unit 5200 performs image data processing, such as gamma correction, on the image data of each of Y, M, C, and K colors. A halftone generation unit 5213 generates halftone data by performing screen processing and error diffusion processing on the image data subjected to the gamma correction performed by the first data processing unit 5212. The halftone generation unit 5213 stores the generated halftone data in the storage unit 5214. The halftone data is 4-bit image data.

In addition, the image processing unit 5200 performs correction on the image data (halftone data) stored in the storage unit 5214 in accordance with the characteristics of the laser scanner by using the second data processing unit 5215. FIG. 10 illustrates a conversion table for converting halftone data into drive data for generating a PWM signal. The conversion table is stored in a ROM 5101. A first column of the conversion table illustrated in FIG. 10 represents 4-bit image data, which corresponds to one pixel. Each row of the conversion table illustrated in FIG. 10 represents 16-bit drive data, each row corresponding to one of the 4-bit density values. For example, when the image data input from the storage unit 5214 to the second data processing unit 5215 is a bit pattern of "0110", the conversion is as follows. The second data processing unit 5215 converts the image data "0110" into drive data having a bit pattern "0000000000111111" by using the conversion table.

The second data processing unit 5215 performs magnification correction (magnification correction processing) on the bit pattern obtained through conversion using the conversion table. In the magnification correction processing, bit data is inserted into or removed from the bit pattern. The second data processing unit 5215 sets magnification correction data sent from the CPU 300 in an internal register and performs magnification correction processing based on the set magnification correction data. The accuracy of the magnification correction processing performed by the second data processing unit 5215 is not guaranteed unless the setting of the magnification correction data in the internal register is completed. By inserting bit data into the bit pattern, the image width in the main scanning direction can be increased. By removing bit data from the bit pattern, the image width in the main scanning direction can be reduced.

In addition, the second data processing unit 5215 inserts bit data into a bit pattern of the margin on the upstream side in the scanning direction of the laser beam or deletes the bit data from the bit pattern of the margin. In this manner, the second data processing unit 5215 can correct the position of the image relative to the print medium in the main scanning direction (position correction processing). The second data processing unit 5215 sets, in an internal register, the position correction data sent from the CPU 300 and performs position correction processing based on the set position correction data. The accuracy of the position correction processing performed by the second data processing unit 5215 is not guaranteed until setting of the position correction data in the internal register is completed.

The second data processing unit 5215 transmits, to the PWM output unit 357, the bit pattern obtained after performing the magnification correction processing and the position correction processing. In response to a clock signal (not illustrated), the PWM output unit 357 serially outputs the bit data included in the bit pattern bit by bit to a laser driver (hereinafter referred to as an "LD") for the color of the bit pattern (i.e., LD 5301Y, 5301M, 5301C, or 5301K). The signal generated when the PWM output unit 357 serially outputs bit data is a PWM signal. When the PWM output unit 357 outputs "1", a laser beam is emitted from the light source. In contrast, when the PWM output unit 357 outputs "0", a laser beam is not emitted from the light source. The BD 5207Y, BD 5207M, BD 5207C and BD 5207K are described later in exemplary embodiments (BD 207Y, BD 207M, BD 207C, and BD 207K). In addition, the CPU 5100, the ROM 5101, the RAM 5102, and the I/O 5103 are described later in the exemplary embodiment (a CPU 300, a ROM 301, a RAM 302, and an I/O 303).

An example of correction in accordance with the characteristics of a laser scanner is partial magnification correction, which is correction of magnification to be applied to each of sub-areas obtained by dividing an image area in the main scanning direction. The partial magnification correction is performed, for example, in order to correct the difference in magnification caused by the difference in scanning speed between the end portion and the middle portion in the main scanning direction. The difference in scanning speed occurs in laser scanners not including a lens having the f-O characteristic. In addition, even in laser scanners including a lens having the f-O characteristic, the magnification difference occurs due to product-to-product variation in fabricating lens and fluctuation of the lens characteristic due to the environmental changes (a temperature change). Accordingly, partial magnification correction is required for optical scanning devices including an f-O lens. In recent years, to meet the demand for high image quality, the image area has been finely divided into a plurality of sub-areas in the main scanning direction (for example, 32 sub-areas).

In recent years, in order to increase the image forming speed of the image forming apparatus (for example, the number of output sheets per minute), many image forming apparatuses have scanned the photoconductive drum with a plurality of light beams (about 2 to 8). The number of outputs from the PWM output unit 5216 to the optical scanning device 5104 is the same as the number of these light beams. Note that FIG. 7A illustrates the control blocks of a color image forming apparatus using four light beams.

In this case, due to the available space inside the image forming apparatus, the following situation arises in an apparatus in which a circuit board having the image processing unit 5200 thereon and the optical scanning device 5104 are disposed apart from each other. That is, cost related to the number of signal lines (for example, 16) between the PWM output unit 5216 and the LDs 5301Y, 5301M, 5301C, and 5301K is to be incurred. In addition, since the configuration of such an image forming apparatus is complicated, it is difficult to assemble the image forming apparatus at the time of production and it is difficult to maintain the image forming apparatus on site (at the place where the image forming apparatus is installed).

Furthermore, if the PWM output unit 5216 is connected to the LDs 5301Y, 5301M, 5301C, and 5301K by using LVDS (Low voltage differential signaling), the number of required signal lines is doubled.

Figure 7B:
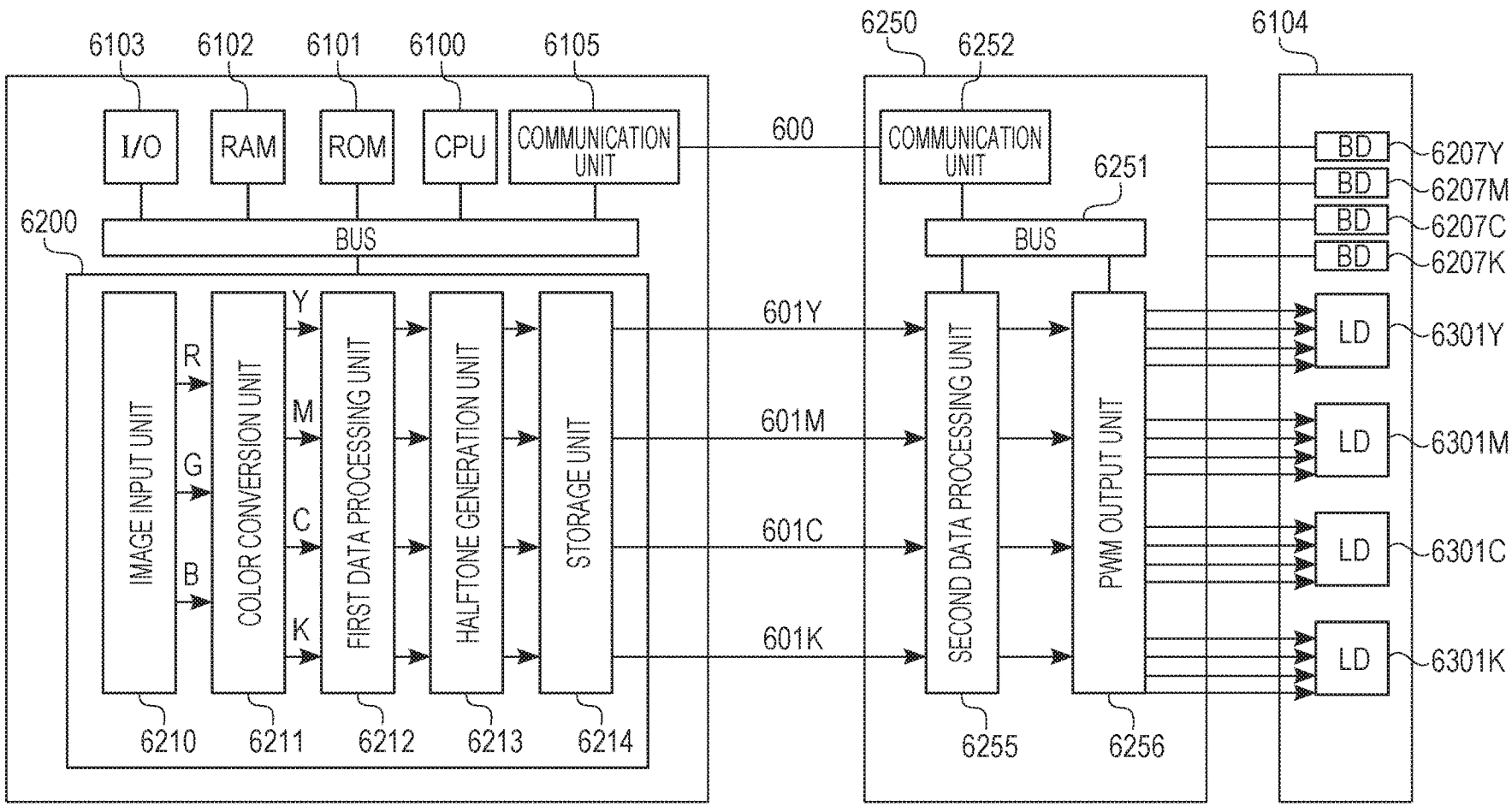
FIG. 7B PRIOR ART

Accordingly, such an image forming apparatus sometimes adopts a configuration illustrated in FIG. 7B as an example. In FIG. 7B, the image processing unit is divided into a first image processing unit 6200 and a second image processing unit 6250, and the image processing unit 6200 fabricated on a single IC chip and the second image processing unit 6250 also fabricated on a single IC chip are mounted on different circuit boards. The circuit board having the second image processing unit 6250 thereon is disposed closer to the optical scanning device 6104 than the circuit board having the first image processing unit 6200 thereon. The second image processing unit 6250 disposed in the vicinity of the optical scanning device 6104 includes a second data processing unit 6255 and a PWM output unit 6256 that perform correction in accordance with the characteristics of the optical scanning device 6104. The control data is received from the CPU 6100 via a communication unit 6105 and a communication unit 6252 which serve as serial communication interfaces (hereinafter referred to as "IFs"). The data are transmitted to the communication unit 6252, the second data processing unit 6255, and the PWM output unit 6256 via a bus 6251. Note that only difference between the configurations of the other units in FIG. 7B and those in FIG. 7A is the reference numerals (5000s for those in FIG. 7A and 6000s for those in FIG. 7B). Thus, descriptions of the units are not repeated.

As illustrated in FIG. 7B, by mounting the first image processing unit 6200 and the second image processing unit 6250 on different circuit boards, the following effects are provided. The first image processing unit 6200 is a general-purpose IC that performs processing that can be widely used for image forming apparatuses with different specifications, such as the image forming speed or the image quality. In contrast, the second image processing unit 6250 is an IC for increasing the performance of the laser scanner, and in one embodiment, the second image processing unit 6250 is designed and fabricated for each of the laser scanners having different specifications.

As illustrated in FIG. 7A, when like the image processing unit 5200, an IC is designed to perform various image processing tasks, the IC is individually designed and fabricated for each of laser scanners having different specifications, which leads to an increase in the cost of a product. In contrast, the first image processing unit 6200 is designed and fabricated so as to be adopted as a general-purpose IC for a plurality of image forming apparatuses having different specifications, and the second image processing unit 6250 is designed and fabricated as an IC having a specification for a laser scanner. As a result, the overall cost of designing and fabricating ICs that perform image processing operations can be reduced.

Figure 8A:
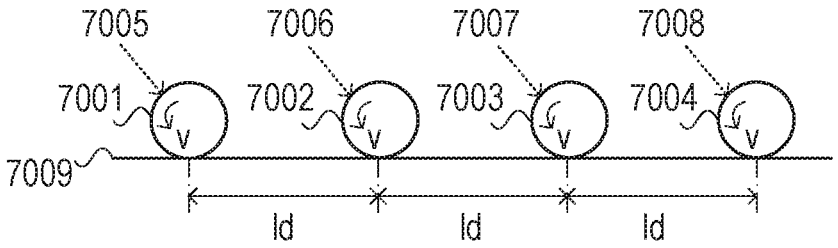
FIG. 8A PRIOR ART
FIG. 8A illustrates the arrangement of photoconductive drums of an existing example.

FIG. 8A illustrates an example of the arrangement of photoconductive drums 7001 to 7004 of a color image forming apparatus in a tandem configuration. For example, the photoconductive drum 7001 is used for a yellow image, the photoconductive drum 7002 is used for a magenta image, the photoconductive drum 7003 is used for a cyan image, and the photoconductive drum 7004 is used for a black image. Arrows illustrated in the photoconductive drums 7001 to 7004 indicate the rotation direction (the counter-clockwise direction) of the photoconductive drums 7001 to 7004, and "v" indicates the rotational speed. Reference numerals 7005 to 7008 denote irradiation positions of the light beams for forming latent images on the photoconductive drums 7001 to 7004, respectively. After latent images formed on the photoconductive drums 7001 to 7004 are developed by developers (not illustrated) to form toner images, the toner images are transferred to the transfer belt 7009, which is an endless belt for transferring the toner images formed thereon. FIG. 8A illustrates part of the transfer belt 7009.

Figure 8B:
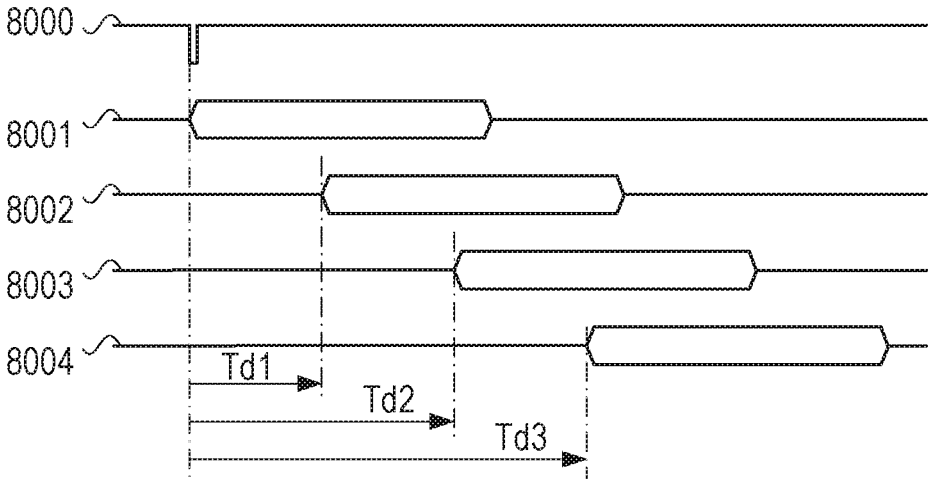
FIG. 8B PRIOR ART
FIG. 8B illustrates transmission start timings of image data.

When a color image is formed by an image forming apparatus in a tandem configuration, the different color toner images formed on the photoconductive drums 7001 to 7004 are to be stacked one on top of the other at the same position on the transfer belt 7009. The photoconductive drums 7001 to 7004 are arranged apart from each other. Let ld be the distance between neighboring ones of the photoconductive drums. Then, if the latent images of respective colors are formed on the photoconductive drums at the same timing, the latent images are transferred to the positions on the transfer belt 7009 which are offset from each other by a distance of ld. Therefore, as illustrated in FIG. 8B, in the color image forming apparatus in a tandem configuration, the latent images of the respective colors are formed by shifting the time of formation. The reference numeral 8000 in FIG. 8B denotes a timing signal which is used as a reference signal (also referred to as a "reference timing signal"), and a latent image 8001 corresponding to the photoconductive drum 7001 is formed at the same timing as the reference timing signal. A latent image 8002 corresponding to the photoconductive drum 7002 is formed by delaying the formation time behind the time of the reference timing signal 8000 by a time period Td1. The latent image 8003 corresponding to the photoconductive drum 7003 is formed by delaying the formation time behind the time of the reference timing signal 8000 by a time period Td2. The latent image 8004 corresponding to the photoconductive drum 7004 is formed by delaying the formation time behind the time of the reference timing signal 8000 by a time period Td3. Here, the time periods Td1, Td2, and Td3 are calculated as follows:

$$Td1=ld/v,$$

$$Td2=1d/v\times 2, \text{ and}$$

$$Td3=ld/v\times 3 \quad (1).$$

Referring to the control block diagram in FIG. 7A (or FIG. 7B), after the time periods Td1, Td2, and Td3 are calculated by the CPU 5100 (6100), the calculated time periods are stored in a register (not illustrated) in the image processing unit 5200 (6200) as control data.

The image data of each of Y, M, C, and K colors that is input from the image input unit 5210 (6210) and that is subjected to several image processing operations is temporarily stored in the storage unit 5214 (6214). At the stage of forming images on the photoconductive drums 7001 to 7004, the CPU 5100 (6100) instructs the image processing unit 5200 (6200) to generate a reference timing signal. Note that the reference timing signal is generated to be used for starting image-writing for one page. The image processing unit 5200 (6200) sequentially transmits the image data of respective colors to the second data processing unit 5215 (6255) and the PWM output unit 5216 (6256) in accordance with the time periods Td1, Td2, and Td3 stored in the above-described register. Note that in the case of the configuration illustrated in FIG. 7B, the image data of respective colors are transmitted from the first image processing unit 6200 to the second data processing unit 6255 via the signal lines 601Y to 601K. Finally, the image data is converted into an on/off operation of the laser beam by the LD 5301 (6301), and the laser beam is emitted onto the surface of each of the photoconductive drums 7001 to 7004. In this manner, latent images are formed. The image processing unit 5200 (6200) transmits the image data corresponding to each of the photoconductive drums 7001 to 7004 in the following manner. That is, by using the reference timing signal, the image processing unit 5200 (6200) transmits the image data at the timings based on the distances from the photoconductive drum 7001, which is disposed most upstream in the movement direction of the transfer belt 7009, to each of the other photoconductive drums 7002, 7003, and 7004. In this manner, when forming an image on a print medium, the image forming apparatus delays the start timing of formation of the electrostatic latent image on, for example, the photoconductive drum 7002 from the start timing of formation of the electrostatic latent image on the photoconductive drum 7001 based on the delay amount corresponding to the distance (ld) between the transfer positions.

Figure 9A:
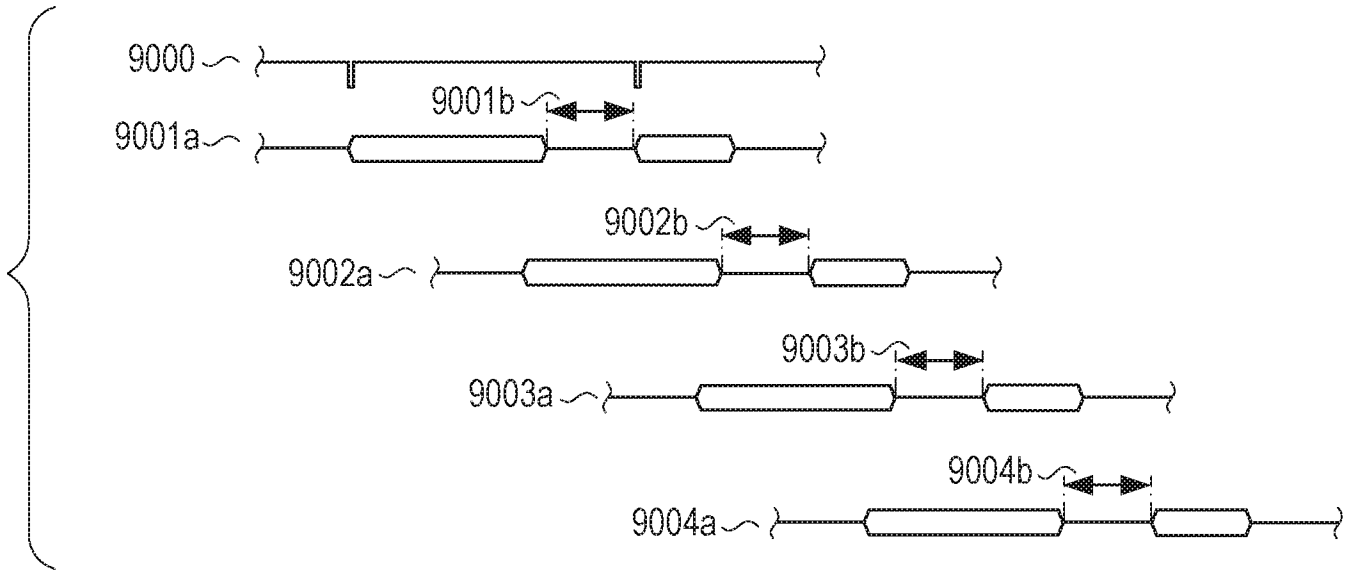
FIG. 9A PRIOR ART
FIG. 9A illustrates a time period during which control data for each color is transmitted.

Note that image forming apparatuses widely used in recent years can not only print pages consecutively but also insert a separator sheet between printouts, for example, between chapters each composed of a plurality of print media or between the print media when a plurality of pages are printed. While consecutively printing sheets having a predetermined length in the conveyance direction of the sheets, the image forming apparatuses can form an image on a sheet having a length that differs from the predetermined length. In particular, when the sizes of the printout and the separator sheet differ from each other, that is, when the size of the print medium to be printed is switched during continuous printing, the following control is required. That is, the CPU (5100, 6100) is to newly set the control data in the image processing units (5200, 6200, and 6250). Thereafter, the CPU is to perform image formation in accordance with the switched print medium. Transmission of the control data for the print medium after the sheet size is switched is performed in a period during which transmission of the image data is not performed, as indicated by reference numerals 9001*b* to 9004*b* in FIG. 9A. In FIG. 9A, a horizontally long hexagon indicates a period during which the image data is being transmitted (hereinafter referred to as a "transmission period"). The same applies to the following drawings. Reference numeral 9000 denotes a reference timing signal. Reference numeral 9001*a* denotes a period during which image data for forming a Y latent image is being transmitted, and reference numeral 9002*a* denotes a period during which image data for forming an M latent image is being transmitted. In addition, reference numeral 9003*a* denotes a period during which image data for forming a C latent image is being transmitted, and reference numeral 9004*a* denotes a period during which image data for forming a K latent image is being transmitted.

As illustrated in FIG. 7B, in order to avoid an increase in the cost of the signal lines and a decrease in the maintainability, some image forming apparatuses have a configuration in which the CPU 6100 transmits the control data to the second image processing unit 6250 via the signal line 600 which is a serial communication line. In the image forming apparatuses having such a configuration, the time period from the start to the end of transmitting control data is determined by the baud rate of communication and the number of communication data. In the image forming apparatuses, in order to increase the image quality of the image forming apparatus, control data, that is, the number of communication data is increased, while a low baud rate is employed. Thus, the cost for reducing noise is reduced and, at the same time, the total cost is reduced. Particularly, in the case of the image forming apparatus having such a configuration, the ratio of the time period required to transmit the control data to the periods 9001*b* to 9004*b* during which no image data is transmitted via the signal lines 601Y to 601K, respectively, has a predetermined value.

Figure 9B:
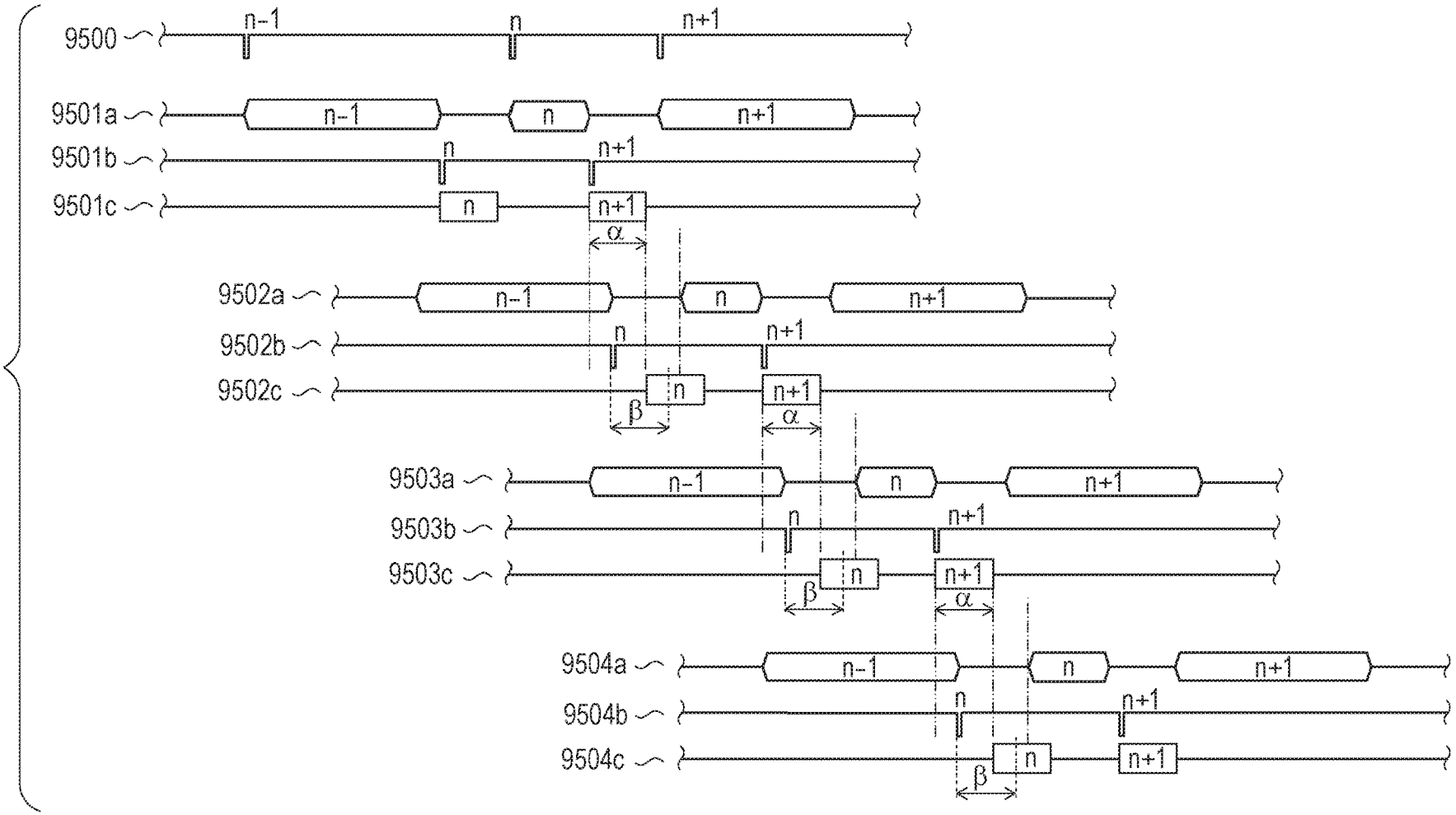
FIG. 9B PRIOR ART
FIG. 9B illustrates transmission timings of image data of each color and control data according to the existing example.

In this case, when a separator sheet having a different size is inserted between print media during continuous printing as described above, the sizes of the latent images formed before and after the separator sheet is inserted are different. Accordingly, the CPU 6100 is to continuously transmit the control data to the second image processing unit 6250 via the signal line 600 before and after transmission of the image data of the separator sheet from the first image processing unit 6200 to the second image processing unit 6250. FIG. 9B illustrates signal and data transmission when a separator sheet having a different size is inserted between the print media during continuous printing. In addition, FIG. 9B illustrates the case where the user intends to perform setting of the image forming apparatus so that a print medium is inserted as the nth sheet between the (n−1)th print medium and the (n+1)th print medium. Furthermore, FIG. 9B illustrates the timings of transmission of the image data from the first image processing unit 6200 to the second image processing unit 6250 and the control data from the CPU 6100 to the second image processing unit 6250 in this case. Reference numeral 9500 denotes the reference timing signal, and reference numerals 9501*a* to 9504*a* denote transmission periods of the image data of respective colors via the signal lines 601Y to 601K. Reference numerals 9501*b* to 9504*b* denote the signals that trigger the start of communication of the control data via the signal line 600 which is a serial communication line (hereinafter, the signals are referred to as "communication start triggers"). Reference numerals 9501*c* to 9504*c* denote actual communication periods of control data from the first image processing unit 6200 to the second image processing unit 6250 via the common signal line 600. More specifically, reference numeral 9501*a* denotes data transmitted via the signal line 601Y. Reference numeral 9502*a* denotes data transmitted via the signal line 601M. Reference numeral 9503*a* denotes data transmitted via the signal line 601C. Reference numeral 9504*a* denotes data transmitted via the signal line 601K. Reference numerals 9501*c*, 9502*c*, 9503*c*, and 9504*c* are data transmitted via the common signal line 600. For ease of description, reference numerals 9501*c*, 9502*c*, 9503*c*, and 9504*c* separately appear in FIG. 9B. In addition, reference numerals 9500, 9501*b*, 9502*b*, 9503*b*, and 9504*b* are trigger signals generated inside the CPU 6100. These signals may be the same signal or a signal generated separately, as illustrated in FIG. 9B.

The Y color, which is a first color, is described with reference to FIG. 9B. The image data for the (n−1)th print medium is transmitted via the signal line 601Y (9501*a_n*−1). Immediately after the transmission of the image data for the (n−1)th print medium is completed, a communication start trigger (9501*b_n*) of the control data for the nth print medium is generated. The communication period (9501*c_n*) of the control data for the nth print medium transmitted via the signal line 600 is terminated before transmission (9501*a_n*) of the nth image data via the signal line 601Y is started. Similarly, the image data for the nth print medium is transmitted (9501*a_n*) via the signal line 601Y. Immediately after the transmission of the image data for the nth print medium is completed, the communication start trigger (9501*b_n*+1) of the control data for the (n+1)th print medium is generated. The communication period (9501*c_n*+1) of the control data transmitted for the (n+1)th print medium via the signal line 600 is terminated before the transmission (9501*a_n*+1) of the image data for the (n+1)th print medium via the signal line 601Y is started.

The processing for M color, which is the next color, is described below. The image data for the (n−1)th print medium is transmitted via the signal line 601M (9502*a_n*−1). Immediately after the transmission of the image data for the (n−1)th print medium is completed, the communication start trigger of the control data for the nth print medium is generated (9502*b_n*). However, the processing for the next M color is performed during the transmission of the control data for Y color via the signal line 600 (during a period α of 9501*c*). Therefore, communication is not started in the expected communication period β, and the communication is started with a delay. Thus, the communication of the control data does not end before transmission of the image data of the n-th print medium via the signal line 600M (9502*a_n*) starts. Image formation for M color is to be performed based on the time interval indicated by the above-described expression (1), since image formation of the nth print medium for Y color has already started. However, if, as described above, communication of the control data via the common signal line 600 is too late for transmission of the image data, there is a possibility that the control data is not transmitted from the CPU 6100 to the second image processing unit 6250 before the image is formed. In this case, the image cannot be formed correctly. The same also applies to the C and K colors. Note that such a situation does not always occur, and the situation may occur depending on the interval ld between neighboring ones of the photoconductive drums 7001 to 7004, the distance between the neighboring print media, the length of the print medium for forming an image in the sub-scanning direction, the baud rate, and the amount of the control data.

In the existing technology, to avoid the occurrence of such a situation, a method for increasing the communication speed of serial communication can be applied first. However, to increase the communication speed, the clock speed for serial communication is increased and, thus, parts for blocking noise, such as a shield, are required, which leads to an increase in the cost. As another method for avoiding such a situation, a method for expanding the interval between the trailing edge of a first image and the leading edge of a second (next) image can be employed. This can be accomplished simply by lowering the throughput. However, in this case, the performance achieved by the original specification of the product is degraded. Alternatively, to keep the throughput of the image forming apparatus constant, if the rotational speed v of the photoconductive drum is increased, the distance between the leading edge of an image and the trailing edge of the next image is increased and, thus, the increased time is available for communication of the control data. However, in this case, a higher-power motor for driving the photoconductive drum or the intermediate transfer belt may be needed, which also leads to an increase in the cost. Still alternatively, the following method can be employed. Only when the control data is switched, the next control data for Y color is communicated after completion of communication of the control data for K color. Thus, overlapping of the communication periods of the control data can be reliably prevented. However, according to the method, the sheet-to-sheet interval increases more than necessary. Accordingly, for example, in a mode of inserting a separator sheet between printouts, the throughput decreases with increasing number of separator sheets inserted between printouts.

EXEMPLARY EMBODIMENT

Image Forming Apparatus

Figure 1A:
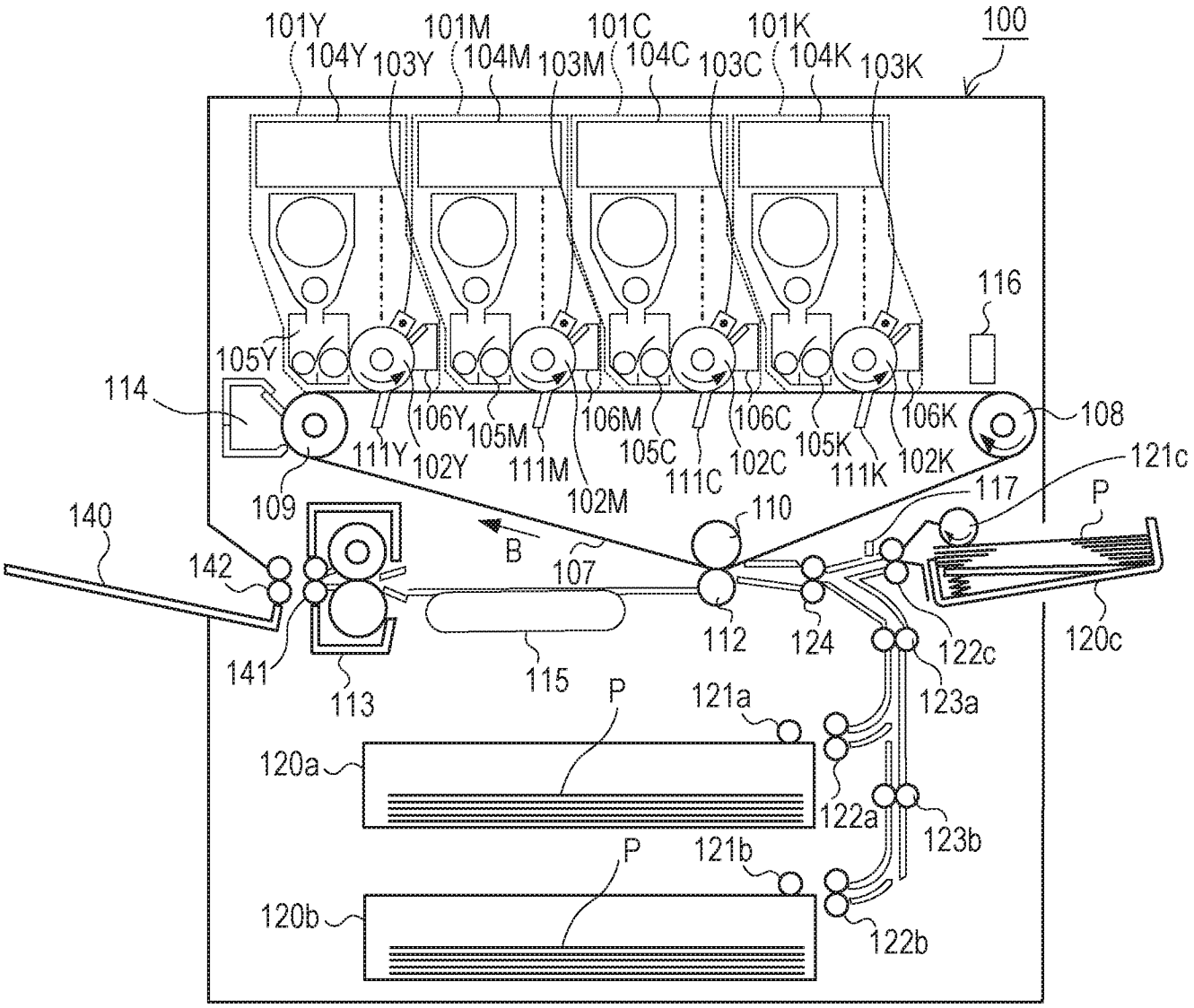
FIG. 1A illustrates the overall configuration of an image forming apparatus according to an exemplary embodiment.

FIG. 1A is a schematic sectional view of a color image forming apparatus having toner of a plurality of colors. The image forming apparatus 100 includes four image forming units 101Y, 101M, 101C, and 101K that form images for respective colors. The image forming unit 101Y functions as a first toner image forming unit, and the image forming unit 101M functions as a second toner image forming unit. As used herein, Y, M, C, and K represent yellow, magenta, cyan, and black, respectively. The image forming units 101Y, 101M, 101C, and 101K perform image formation using toner of yellow, magenta, cyan, and black, respectively. Hereinafter, suffixes Y, M, C, and K of reference numerals are removed except when necessary. The image forming unit 101 is provided with a photoconductive drum 102 which is a photoconductor. The photoconductive drum 102Y for yellow functions as a first photoconductor, and the photoconductive drum 102M for magenta functions as a second photoconductor. A charging device 103, an optical scanning device 104, and a developing device 105 are provided around the photoconductive drum 102. Note that an optical scanning device 104Y for yellow functions as a first exposure unit, and an optical scanning device 104M for magenta functions as a second exposure unit. A developing device 105Y functions as a first development unit for developing, with the toner of the first color, the first electrostatic latent image formed on the photoconductive drum 102Y by the optical scanning device 104Y that performs exposure. The developing device 105M functions as a second development unit that develops, with the toner of the second color, the second electrostatic latent image formed on the photoconductive drum 102M by the optical scanning device 104M that performs exposure. Note that a cleaning device 106 is further disposed around the photoconductive drum 102.

Below the photoconductive drum 102, an intermediate transfer belt 107, which is an endless belt, is disposed. The intermediate transfer belt 107 is entrained about a driving roller 108 and the driven rollers 109 and 110. The intermediate transfer belt 107 rotates in the direction of an arrow B (the clockwise direction) in FIG. 1A during image formation. In addition, a primary transfer device 111 is provided at a position facing the photoconductive drum 102 with the intermediate transfer belt 107 therebetween. The transfer position of the toner image from the photoconductive drum 102Y to the intermediate transfer belt 107 in the rotational direction of the intermediate transfer belt 107 is located upstream of the transfer position of the toner image from the photoconductive drum 102M to the intermediate transfer belt 107. In addition, the image forming apparatus 100 further includes a secondary transfer roller 112 and a fixing device 113. The secondary transfer roller 112 transfers a toner image on the intermediate transfer belt 107 (on the belt) to a sheet P, which is a print medium. The fixing device 113 fixes an unfixed toner image on the sheet P. The primary transfer device 111Y, the primary transfer device 111M, the intermediate transfer belt 107, the driving roller 108, the driven rollers 109 and 110, and the secondary transfer roller 112 function as a transfer unit.

During the printing operation, the photoconductive drum 102 and the intermediate transfer belt 107 are driven to rotate in the direction of the arrow in FIG. 1A by a drive mechanism (not illustrated), and a printed image is formed through a series of steps for image formation. The surface of the photoconductive drum 102Y is uniformly charged to have a predetermined potential by a voltage applied by the charging device 103Y in a charging step. Thereafter, the surface of the photoconductive drum 102Y is exposed to a laser beam emitted from the optical scanning device 104Y in an exposure step. Normally, the laser beam is turned on and off in accordance with the data of the document image and, thus, a potential difference corresponding to the data of the document image is generated on the surface of the photoconductive drum 102Y. In this manner, an electrostatic latent image is formed. Thereafter, by applying a voltage to the developing device 105Y to keep the toner in the developing device 105Y at a predetermined potential, the electrostatic latent image is developed to form a yellow toner image on the surface of the photoconductive drum 102Y in the next development step. For the magenta, cyan, and black colors, toner images are formed on the surfaces of the photoconductive drums 102M, 102C, and 102K, respectively, through the same process as described above. In the next primary transfer step, the toner images of respective colors formed on the photoconductive drums 102 are transferred from the surfaces of the photoconductive drums 102 to the surface of the intermediate transfer belt 107 by applying a primary transfer voltage to the primary transfer device 111. At this time, the toner images of respective colors are stacked one on top of the other.

The toner images stacked on the surface of the intermediate transfer belt 107 are transferred onto the surface of the sheet P conveyed from the first paper feed cassette 120*a* by applying a secondary transfer voltage to the secondary transfer roller 112 in the next secondary transfer step. Note that the sheet P is conveyed from the paper feed cassette 120*a* to the secondary transfer unit by conveyance rollers 121*a*, 122*a*, 123*a*, and 124 that are rotationally driven by a driving mechanism (not illustrated). Furthermore, the image forming apparatus includes a second paper feed cassette 120*b* and a manual paper feed tray 120*c*. The sheet P fed from the second paper feed cassette 120*b* is conveyed to the secondary transfer unit by conveyance rollers 121*b*, 122*b*, 123*b*, and 124 that are rotationally driven by a drive mechanism (not illustrated). The sheet P fed from the manual paper feed tray 120*c* is conveyed to the secondary transfer unit by conveyance rollers 121*c*, 122*c*, and 124 that are rotationally driven by a drive mechanism (not illustrated). The first paper feed cassette 120*a* and the second paper feed cassette 120*b* allow the sheets P having a plurality of sizes to be set therein. The size of the sheets P set in each of the first paper feed cassette 120*a* and the second paper feed cassette 120*b* is detected by a size detection device (not illustrated), and the result of detection is output to the CPU 300. Thus, the CPU 300 can detect the size of the sheets P set in each of the first paper feed cassette 120*a* and the second paper feed cassette 120*b*. In addition, the manual paper feed tray 120*c* allows the sheets P having a plurality of sizes to be set therein. The manual paper feed tray 120*c* has a size sensor 117 disposed therein. The size sensor 117 detects the size of sheets set in the manual paper feed tray 120*c*. The CPU 300 can identify the size of the sheet P conveyed from the manual paper feed tray 120*c* to the secondary transfer unit based on the result of detection output from the size sensor 117. Note that the CPU 300 may identify the size of the sheet P set in the manual paper feed tray 120*c* based on the information input from the operation panel (not illustrated) by the user. The above-mentioned separator sheet (a print medium inserted between printouts) is fed from the second paper feed cassette 120*b* or the manual paper feed tray 120*c*.

The toner that is not transferred to the sheet P and is remaining on the intermediate transfer belt 107 is collected by a cleaner 114 disposed downstream of the secondary transfer unit in the conveyance direction so as to face the intermediate transfer belt 107. Note that the secondary transfer roller 112 can apply a voltage having a polarity opposite to the secondary transfer voltage for transferring the toner on the surface of the intermediate transfer belt 107 to the sheet P. As a result, the toner adhering to the secondary transfer roller 112 can be moved toward the surface of the intermediate transfer belt 107 and can be corrected by the cleaner 114. Furthermore, the toner on the surface of each of the photoconductive drums 102 that have completed the transfer process is removed by the cleaning device 106. The photoconductive drum 102 from which the toner remaining on the surface has been removed returns to the charging step again as the photoconductive drum 102 rotates. The sheet P having the toner image transferred in the secondary transfer unit is conveyed to the fixing device 113 by the conveyance belt 115. The toner image transferred onto the sheet P is heated and fixed on the sheet P by the fixing device 113. Finally, the sheet P having the full color image formed thereon in this manner is output to a discharge unit 140 via conveyance rollers 141 and 142 that are rotatingly driven.

The sensor 116 serving as a detection unit is a sensor for detecting an image formed on the intermediate transfer belt 107. In some cases, to control the image quality, the image forming apparatus 100 forms one of detection toner images called "patches" having a variety of sizes and patterns between a toner image to be transferred onto the sheet P and a toner image to be transferred to the succeeding sheet P during continuous printing. Hereinafter, the detection toner image called a patch of a variety of sizes and patterns is referred to as a "patch image". The sensor 116 detects a patch image formed on the intermediate transfer belt 107 and outputs the result of detection to the CPU 300 (described in more detail below). The CPU 300 corrects the image data based on the result of detection performed by the sensor 116. When a patch image, which is a predetermined toner image, is formed during continuous printing, a situation that is the same as the above-described situation occurring when a separator sheet is inserted arises, since the size of the sheet P differs from the size of the patch image (refer to FIG. 9B).

Optical Scanning Device

Figure 1B:
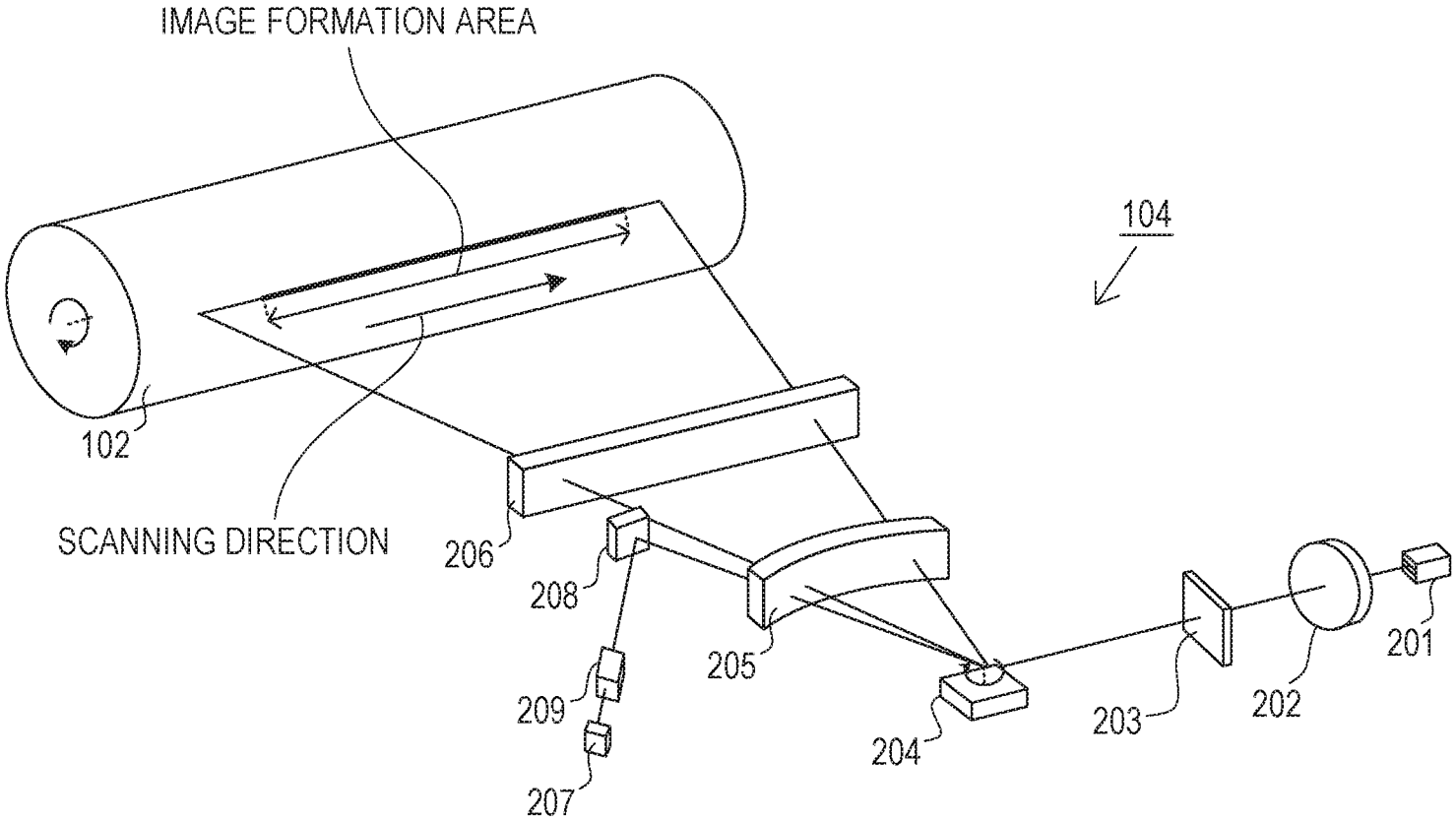
FIG. 1B illustrates a main part of an optical scanning device.

FIG. 1B illustrates the internal configuration of the optical scanning device 104 that emits a light beam. The optical scanning device 104 includes a semiconductor laser 201 serving as a light source, a collimator lens 202, a cylindrical lens 203, and a rotary polygon mirror 204. The semiconductor laser 201 generates, for example, four laser beams as the light beam. The collimator lens 202 shapes the laser beams emitted from the semiconductor laser 201 into a parallel light beam. The cylindrical lens 203 condenses the laser beam that has passed through the collimator lens 202 in the sub-scanning direction. Furthermore, the optical scanning device 104 includes a first scanning lens 205 on which the laser beam (the scanning beam) deflected by the rotary polygon mirror 204 is incident and a second scanning lens 206. The rotary polygon mirror 204 is rotated by a drive motor (not illustrated) which drives the rotary polygon mirror 204 during the printing operation. The angle of the laser beam emitted from the semiconductor laser 201 is continuously changed by the reflecting surfaces of the rotary polygon mirror 204 that is rotating. Thus, the laser beam is deflected. The laser beam deflected by the rotary polygon mirror 204 passes through the first scanning lens 205 and the second scanning lens 206 and scans the photoconductive drum 102 in the main scanning direction which is the scanning direction. In this manner, the surface of the photoconductive drum 102 is exposed to form an electrostatic latent image. An area where an electrostatic latent image is formed in the main scanning direction is defined as an image formation area.

A mirror 208 is disposed between the first scanning lens 205 and the second scanning lens 206 at an end portion of the scanning range of laser beam (outside the image formation area on the photoconductive drum 102). The mirror 208 reflects the laser beam incident through the first scanning lens 205 and folds back the optical path of the laser beam. The laser beam whose optical path is folded is detected by a beam detector (BD) 207 through a lens 209. Upon detecting the laser beam emitted from the semiconductor laser 201, the BD 207 outputs a signal to the CPU 300 (described in more detail below). By using the signal input from the BD 207 (hereinafter referred to as a "synchronization signal") as a reference, the CPU 300 emits a laser beam corresponding to the image data from the semiconductor laser 201 to the image formation area. Thus, the CPU 300 aligns the image forming start positions of the electrostatic latent image (the image) in the main scanning direction for all of the scanning operations. As described above, the synchronization signal is a signal for synchronizing the writing start timings in the main scanning direction. Note that the image forming unit 101 does not necessarily have to be of a type that exposes the photoconductive drum 102 by deflecting and scanning a laser beam with the rotary polygon mirror 204 as described above. For example, another technique in which the photoconductive drum 102 is directly irradiated with LED light and is exposed may be used.

Control Block Diagram

Figure 2:
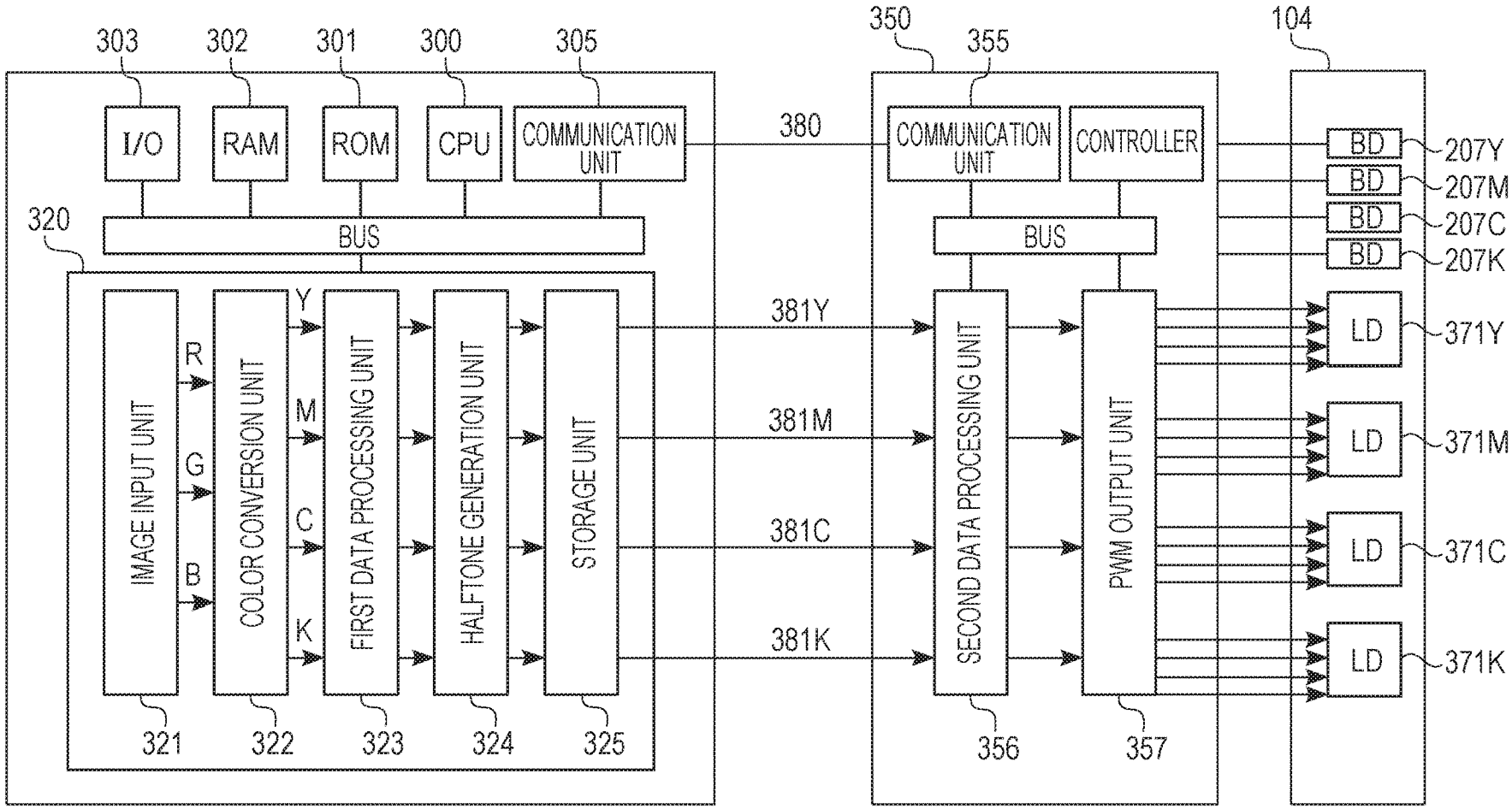
FIG. 2 is a block diagram of an image forming apparatus according to an exemplary embodiment.

FIG. 2 is a block diagram of the configuration of a control circuit for controlling driving of the optical scanning device 104. The image forming apparatus 100 includes the CPU 300 serving as a control unit, a ROM 301 that stores a control program of the CPU 300, and a RAM 302 that provides a work area. The image forming apparatus 100 further includes an I/O 303 used to receive input signals from a variety of sensors and output signals to the actuators, such as motors, a communication unit 305 for performing serial communication, and an image processing unit 320 (a first image processing unit). The image processing unit 320 is a data generation circuit (a data generation unit) that generates first image data for a first color and second image data for a second color from input image data. These units communicate data via a bus. Furthermore, the image forming apparatus 100 according to the present exemplary embodiment includes an image processing unit 350 (a second image processing unit). The image processing unit 320 and the image processing unit 350 are different ICs. The image processing unit 350 is disposed at a position closer to the optical scanning device 104 than the image processing unit 320. The image processing unit 320 and the image processing unit 350 are different ICs mounted on different circuit boards. The CPU 300 is mounted on the circuit board having the image processing unit 320 mounted thereon. Transmission of the control data from the CPU 300 to the image processing unit 320 is performed electrically by printed wiring formed on the circuit board. The image processing unit 350 includes a second data processing unit 356 and a PWM output unit 357. The second data processing unit 356 performs correction in accordance with the characteristics of the optical scanning device. Reception of the control data from the CPU 300 is performed by the communication unit 305 and the communication unit 355 which are serial communication interfaces (IFs). The second data processing unit 356 is a data processing circuit (a data processing unit) that generates first drive data obtained by performing the magnification correction processing on the first image data and generates second drive data obtained by performing the magnification correction processing on the second image data based on the magnification correction data that has been set. In addition, the second data processing unit 356 generates first drive data obtained by performing, for the first image data, position correction processing for correcting the position of the toner image relative to the print medium based on the set position correction data. The second data processing unit 356 generates second drive data obtained by performing, for the second image data, position correction processing for correcting the position of the toner image relative to the print medium based on the set position correction data. The communication unit 305 and the communication unit 355 are connected by a second signal line 380. That is, the common signal line 380 is connected to the circuit board having the image processing unit 320 mounted thereon and the circuit board having the second data processing unit 356 mounted thereon. The CPU 300 serially transmits, to the second data processing unit 356, the magnification correction data or the position correction data for the first image data and the magnification correction data or the position correction data for the second image data by using the common signal line 380. In addition, the CPU 300 transmits control data other than the magnification correction data or control data other than the position correction data to the second data processing unit 356 via the common signal line 380. By employing such a configuration, an increase in the cost of the signal lines between the PWM output unit 357 having a large number of signal lines and the LD 371 (371Y, 371M, 371C, and 371K) can be prevented. In addition, a decrease in the maintainability can be prevented. Note that the LD 371Y for yellow functions as a first drive unit that drives the optical scanning device 104Y based on the first drive data. The LD 371M for magenta functions as a second drive unit that drives the optical scanning device 104M based on the second drive data.

Arrows pointing from the left to the right in the image processing unit 320 indicate the processes to be applied to image data input from an external device, such as a document reader or a computer. The image data input from the external device is composed of data for each of colors red (R), green (G) and blue (B) and is input to the image input unit 321. The image processing unit 320 converts the image data of each of R, G, and B colors input from the external device into an image for each of the colors (Y, M, C, and K) of the toner of the image forming apparatus 100 by the color conversion unit 322. The image processing unit 320 performs image processing, such as gamma correction, on the image data of each of the colors Y, M, C, and K by using the first data processing unit 323. By using the halftone generation unit 324, the image processing unit 320 performs screen processing or error diffusion processing on the image data subjected to image processing. Thus, the image processing unit 320 generates halftone data and supplies the generated halftone data to the storage unit 325, which stores the halftone data.

In addition, the image data for each color stored in the storage unit 325 is transmitted from the image processing unit 320 to the image processing unit 350. For example, the Y color image data is transmitted via the signal line 381Y, the M color image data is transmitted via the signal line 381M, the C color image data is transmitted via the signal line 381C, and the K image data is transmitted via the signal line 381K. The image processing unit 350 corrects the image data of each color transmitted from the image processing unit 320 via the signal lines 381 (the plurality of first signal lines) by using the second data processing unit 356 in accordance with the characteristics of the optical scanning device 104. Thereafter, by using the PWM output unit 357, the image processing unit 350 converts the image data corrected in accordance with the characteristics of the optical scanning device 104 into the PWM analog signal representing the laser on/off pattern. The image processing unit 350 outputs the PWM analog signal converted by the PWM output unit 357 to the LD 371 in the optical scanning device 104 for each color to form a latent image on the surface of each of the photoconductive drums 102.

The CPU 300 stores, in a register (not illustrated) of the image processing unit 320, the time periods Td1, Td2, and Td3 calculated based on Expression (1) described above. Thereafter, at the stage of forming an image, the CPU 300 instructs the image processing unit 320 to generate a reference timing signal. Upon receiving the instruction, the image processing unit 320 sequentially transmits the image data for each color from the storage unit 325 to the image processing unit 350 in accordance with the time periods Td1, Td2, and Td3 stored in the register.

Image Formation Timing

Figure 3:
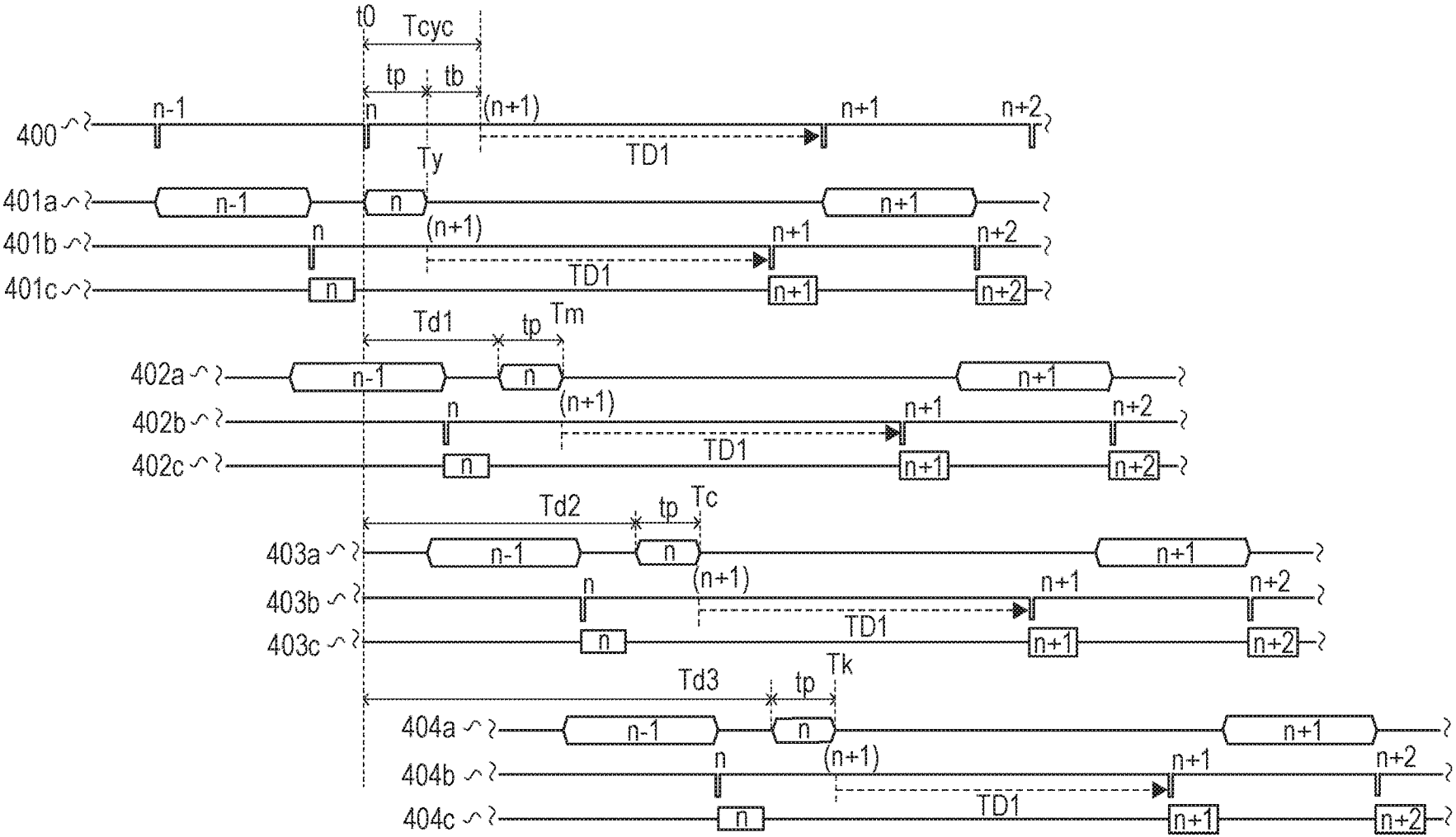
FIG. 3 illustrates a transmission period of image data according to the exemplary embodiment.

FIG. 3 illustrates a method for use in the CPU 300 to calculate the image formation timing for each color. In FIG. 3, images to be printed on three print media n−1, n, and n+1 are generated. Reference numeral 400 in FIG. 3 denotes a reference timing signal, and a reference timing signal is generated for each of the print media. Reference numerals 401, 402, 403, and 404 denote transmission periods for Y, M, C, and K, respectively. Image data 401*a* is transmitted via the signal line 381Y. Image data 402*a* is transmitted via the signal line 381M. Image data 403*a* is transmitted via the signal line 381C. Image data 404*a* is transmitted via the signal line 381K. Control data 401*c*, 402*c*, 403*c*, and 404*c* are transmitted via the common signal line 380. For ease of description, in FIG. 3, the control data 401*c*, 402*c*, 403*c*, and 404*c* are separately illustrated. In addition, trigger signals 400, 401*b*, 402*b*, 403*b*, and 404*b* are generated inside the CPU 300. These signals may be the same signal or may be generated separately as illustrated in FIG. 3. In the following description, the timing control for image formation performed by the CPU 300 is described by focusing on the nth sheet. Note that Y image data for the nth sheet is referred to as "image data 401*a_n*", M image data for the nth sheet is referred to as "image data 402*a_n*", C image data for the nth sheet is referred to as "image data 403*a_n*", and K image data for the nth sheet is referred to as "image data 404*a_n*".

In addition to the above-described time periods Td1, Td2, and Td3, the CPU 300 calculates a time period tp required for transmission of the image data 401*a_n*, 402*a_n*, 403*a_n*, and 404*a_n*. Let 1*p* be the length of the image to be formed on the sheet P in the sub-scanning direction, and let v be the driving speed (i.e., the rotational speed) of the photoconductive drum 102 and the intermediate transfer belt 107. Then, the time period tp is given as follows:

$$Tp=lp/v \tag{2}$$

From Expressions (1) and (2), the timing (hereinafter, referred to as "transmission end timing") at which the transmission of the image data of each of colors Y, M, C, and K with respect to the nth reference timing signal 400 (hereinafter referred to as "400_*n*") is completed is given as follows:

$$\begin{aligned} &Y:\ tp \\ &M:\ Td1+tp \\ &C:\ Td2+tp \\ &K:\ Td3+tp \end{aligned} \tag{3}$$

Accordingly, the CPU 300 instructs the image processing unit 320 to generate the reference timing signal 400_*n* at a timing to. In addition, to determine the transmission end timing for the image data of each color given by Equation (3), the CPU 300 starts an internal timer. Upon receiving the instruction to generate the reference timing signal 400_*n* from the CPU 300, the image processing unit 320 starts transmitting the image data at the timings based on the time periods Td1, Td2, and Td3 stored in the register (not illustrated).

If the CPU 300 determines that the time tp has elapsed since the time of the reference timing signal 400_*n* by referring to the timer, that is, the transmission end timing of the Y color image data has been reached, the CPU 300 operates as follows. That is, the CPU 300 starts communication of control data for Y color for the (n+1)th sheet via the common signal line 380 at a timing Ty indicated by a broken line as necessary. Note that Ty is the timing to start communication of the control data for Y color based on the timing t0 at which the reference timing signal for the nth sheet is generated. When communication of the control data for the Y color for the (n+1)th sheet is started, the CPU 300 refers to the timer and, in addition, stores the current time in the RAM 302. The details of the process are described below with reference to FIG. 5.

Similarly, if, by referring to the timer, the CPU 300 determines that each of the predetermined time periods has elapsed since the time of the reference timing signal 400*n*, that is, if the CPU 300 determines that the transmission end timing of each of the M, C, and K image data has been reached, the CPU 300 operates as follows. In this case, the predetermined time periods are Td1+tp, Td2+tp, and Td3+tp. The CPU 300 starts communication of control data for each of the colors M, C, and K for the (n+1)th sheet at timings Tm, Tc, and Tk indicated by broken lines, respectively, via a common signal line 380 as needed. Note that at the timing Tm, communication of control data for M color based on the timing t0 at which the nth reference timing signal is generated starts. At the timing Tc, communication of the control data for the C color based on the timing t0 at which the reference timing signal for the nth sheet is generated starts. At the timing Tk, communication of the control data for the K color based on the timing t0 at which the reference timing signal for the nth sheet is generated starts. Communication of control data for each of the colors Y, M, C, and K for the succeeding print medium may be performed every time an image is formed on one print medium or when control data (e.g., the size of the print medium and the correction data) is switched. According to the present exemplary embodiment, description is given on the assumption that control data is transmitted to the second image processing unit 350 every time an image is formed on one print medium.

At the transmission end timing of the Y image data (Ty), the CPU 300 calculates a time period tb used for an instruction to generate a reference timing signal 400_*n*+1 for the (n+1)th sheet is to be sent as follows:

$$tb=Tcyc-tp \tag{4}$$

At the same time, the CPU 300 starts the timer (timer setting).

Note that the time Tcyc is determined based on the specification of the product. For example, in the case of an image forming apparatus capable of printing A3-size sheets at 30 sheets per minute, $$Tcyc=60 \text{ seconds}/30 \text{ sheets}=2 \text{ seconds}$$

where Tcyc is the time period from the leading edge of the print medium to the trailing edge of the succeeding print medium during continuous printing. Alternatively, in the case where the same image forming apparatus can print A4-size sheets at 60 sheets per minute, $$Tcyc=60 \text{ seconds}/60 \text{ sheets}=1 \text{ second.}$$

The correspondence between the sheet size that can be output by the image forming apparatus and the throughput (the number of printable sheets per minute (ppm)) is stored in the ROM 301 in the form of a table in advance, as illustrated in Table. For example, the throughput for A3-size sheet is 30 sheets per minute (30 ppm) and the throughput for A4 size paper is 60 sheets per minute (60 ppm). By referring to Table, the CPU 300 calculates the time period Tcyc.

TABLE

| Sheet Size | Throughput |
|---|---|
| A3 | 30 ppm |
| A4 | 60 ppm |

If the CPU 300 refers to the timer and determines that the time period tb has elapsed since the transmission end timing of the nth image data (Ty), the CPU 300 starts a series of processes for transmitting the (n+1)th image data.

The difference between FIG. 3 of the present exemplary embodiment and FIG. 9B is as follows. For example, in FIG. 9B, the C color control data (9503*c*_*n*) is output after the Y color control data (9501*c*_*n*+1) is output. In contrast, according to the present exemplary embodiment, the control data for any one of the colors (401*c*_*n* to 404*c*_*n*) for the nth print medium is output before the control data (401*c*_*n*+1 to 404*c*_*n*+1) for the (n+1)th print medium is output. In addition, according to the present exemplary embodiment, after the data processing performed by the second data processing unit 356 based on the control data (e.g., 401*c*_*n*) for the nth print medium is completed, the control data (e.g., 401*c*_*n*+1) for the (n+1)th print medium is set by the CPU 300. For example, the timing at which the setting of the control data (e.g., 401*c*_*n*+1) for the (n+1)th print medium is delayed by the time period TD1 behind the timing (indicated by "(n+1)" in FIG. 3) in the existing technique illustrated in FIGS. 9A and 9B in which the control of the present exemplary embodiment is not performed. For example, in the case of Y color, the generation of the trigger signal 401*b*_*n*+1 by the CPU 300 is delayed by the time period TD1, and the generation of the trigger signal 400_*n*+1 for the image formation on the (n+1)th print medium is also delayed by the time period TD1. The same applies to M, C and K.

According to the present exemplary embodiment, control is performed so that communication of the control data for the succeeding print medium starts at the transmission end timing (Ty, Tm, Tc, Tk) of the image data. However, for the first sheet of a job (also referred to as a "first print medium"), communication of control data may be started at any time if communication of the control data is completed before the instruction to generate the reference timing signal is transmitted. In addition, the reference timing signal for the first print medium is generated after the image forming apparatus 100 completely enters a print ready mode.

Figure 4:
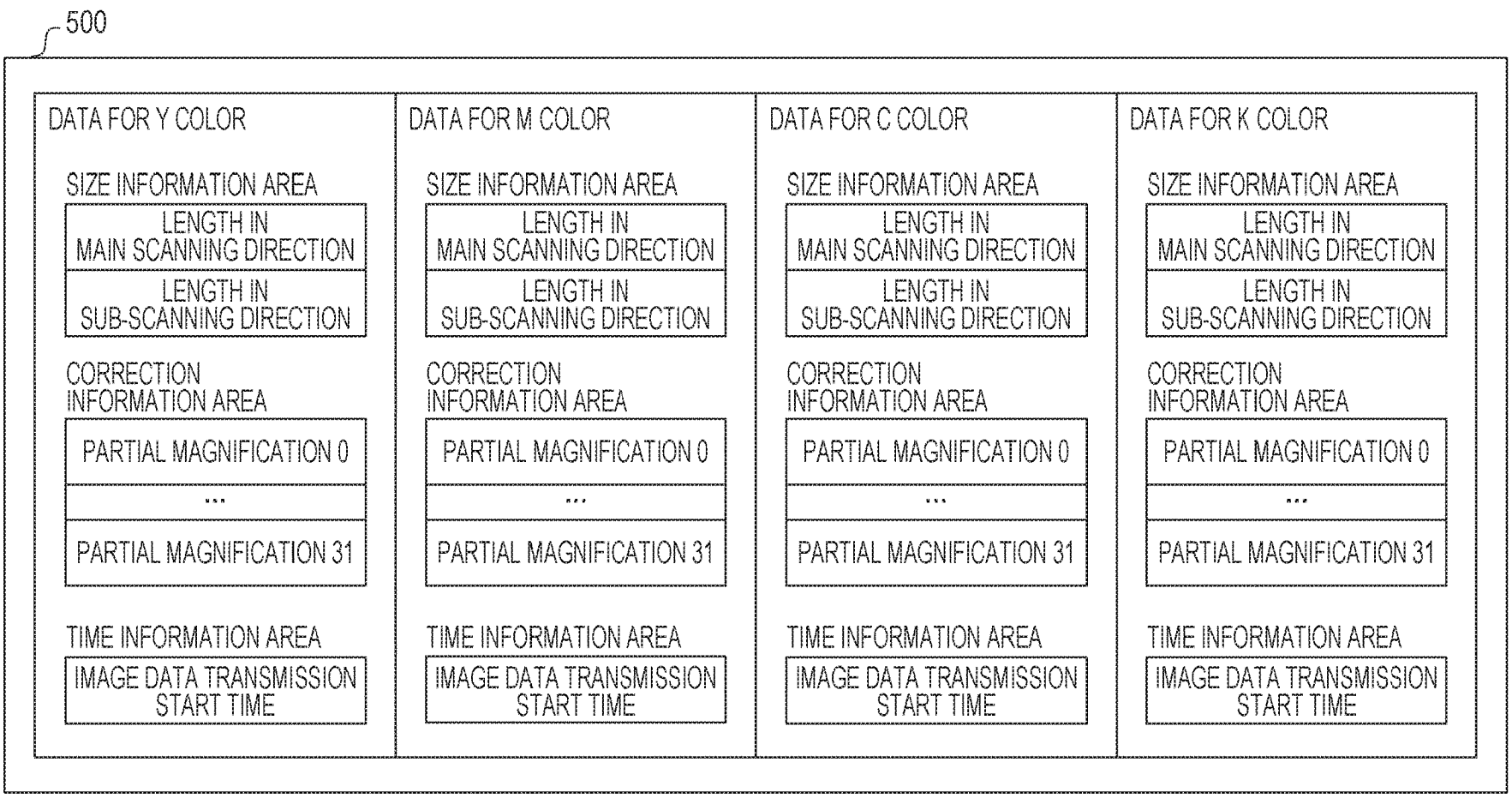
FIG. 4 illustrates control data according to the exemplary embodiment.

FIG. 4 illustrates control data 500 according to the present exemplary embodiment. The control data 500 includes control data corresponding to each of Y color data, M color data, C color data, and K color data. The control data is set for at least each of the sizes of recording media. The control data may be set for each of the types of the recording media (e.g., the basis weight/thickness). The control data 500 for each color includes data related to the lengths of an image formed on a print medium in the main scanning direction and the sub-scanning direction and the image forming position on the print medium. The data forms the size information area of the control data 500. In addition, the control data 500 for each color includes correction data used to correct an image (partial magnification correction data). The image formation area of the optical scanning device 104 (refer to FIG. 1B) is divided into 32 sub-areas in the main scanning direction, and the partial magnification correction data is used to corrects the partial magnification for each of the sub-areas. More particularly, the control data 500 includes the partial magnification correction data corresponding to each of 32 sub-areas from the partial magnification 0 to the partial magnification 31, and the partial magnification correction data constitutes a correction information area of the control data 500. Furthermore, the control data 500 for each color includes the time period from the time of the reference timing signal to the start of the transmission of the image data calculated from expression (1) (i.e., the image data transmission start time), and the time period constitutes the time information area. Note that the control data 500 may include other information. However, the lengths of the same print medium in the main scanning direction and in the sub-scanning direction remain unchanged for all of the colors. The partial magnification correction data has different correction values for the optical scanning devices 104Y, 104M, 104C, and 104K. According to the present exemplary embodiment, the transmission start time of image data is 0 for Y and Td1, Td2, and Td3 for M, C, and K, respectively.

According to the present exemplary embodiment, the CPU 300 functioning as a controller for switching setting of the magnification correction data in accordance with the size of the print medium in the above-described manner performs control as follows. That is, the CPU 300 outputs, to the second data processing unit 356 via the common signal line 380, the magnification correction data for the first image data and the magnification correction data for the second image data at different timings based on the delay amount corresponding to the distance between the transfer positions. In this manner, the CPU 300 switches the magnification correction data that are set in the second data processing unit 356. In addition, according to the present exemplary embodiment, the CPU 300 functioning as a controller for switching the setting of the position correction data in accordance with the size of the print medium performs control as follows. That is, the CPU 300 outputs, to the second data processing unit 356 via the common signal line 380, the position correction data for the first image data and the position correction data for the second image data at different timings based on the delay amount corresponding to the distance between the transfer positions. In this way, the CPU 300 switches the position correction data that are set in the second data processing unit 356.

Communication Timing of Control Data

Figure 5:
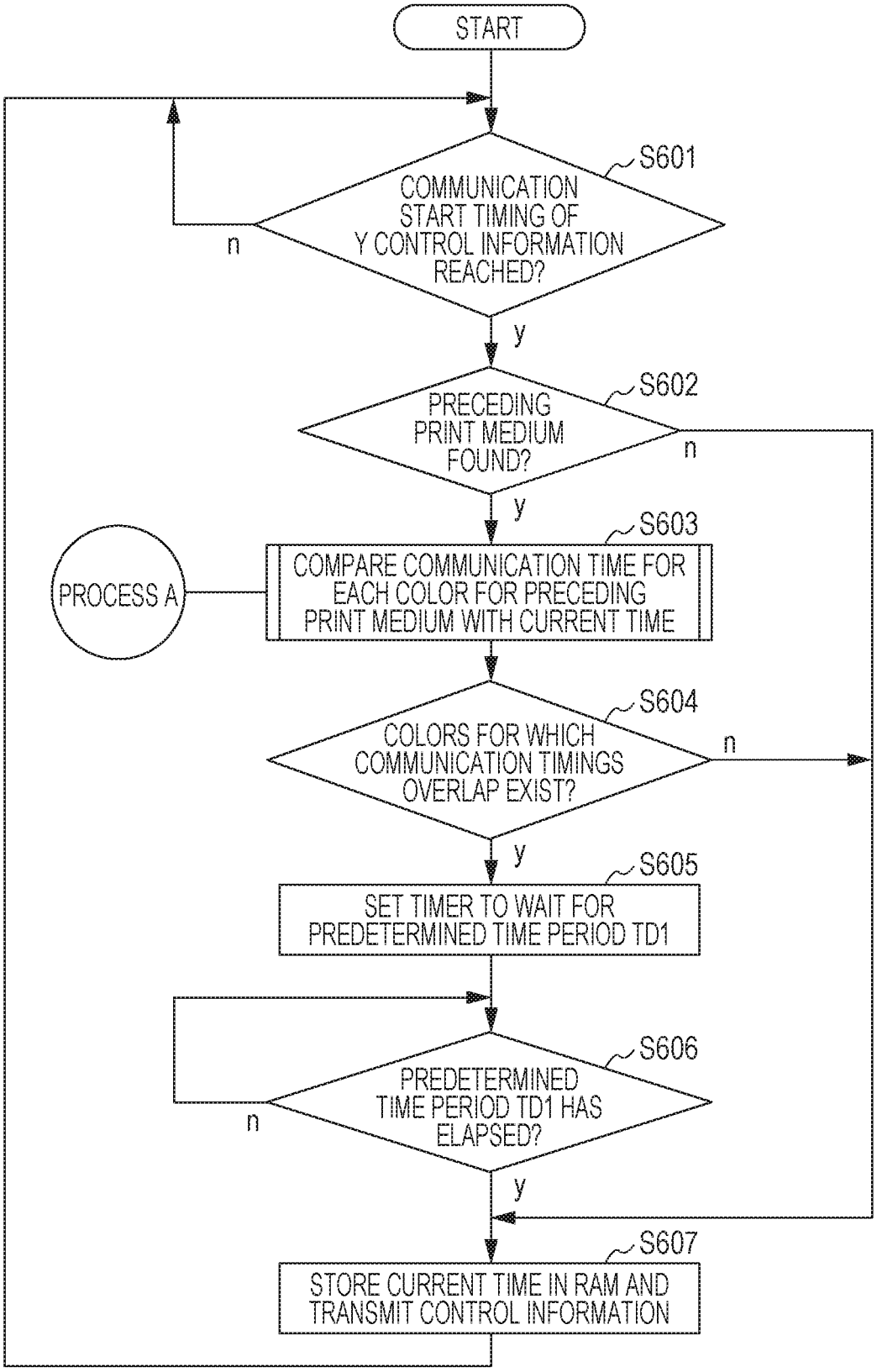
FIG. 5 is a flowchart illustrating control processing of transmission timing of the control data according to the exemplary embodiment.

FIG. 5 is a flowchart illustrating the process of determining whether the timing at which the communication of the control data 500 is performed during continuous printing overlaps the timing at which the control data for another color is communicated and the process of controlling the communication timings of the control data based on the determination result, accordance with the present exemplary embodiment. As illustrated in FIG. 3, the process illustrated in FIG. 5 is performed by the CPU 300 when the transmission end timing (Ty) of the Y image data is reached and the communication timing of the Y control data is reached. Note that the CPU 300 refers to the timer at the timing when the reference timing signal is generated and manages the elapsed time from the time the reference timing signal is generated to each timing described below. In step 601 (hereinafter referred to as "S601" for simplicity), the CPU 300 refers to the timer and determines whether the time period tp has elapsed since the time of the reference timing signal for the nth sheet and the timing at which communication of the control data 500 for Y, which is a predetermined color, has been reached. If, in S601, the CPU 300 determines that the communication start timing of the Y color control data 500 has not been reached, the processing of the CPU 300 returns to S601. However, if the CPU 300 determines that the communication start timing of the Y color control data 500 has been reached, the processing of the CPU 300 proceeds to S602. In S602, the CPU 300 determines whether an (n−1)th sheet P preceding the nth sheet (a preceding print medium) is found. If the CPU 300 determines that no preceding print medium is found, the processing of the CPU 300 proceeds to S607 since the communication timing of the control data 500 does not overlap the processing time of the preceding print medium. In S607, the CPU 300 refers to the timer and stores the current time in the RAM 302. Thereafter, the CPU 300 transmits the control data 500, and the processing returns to S601.

If, in S602, the CPU 300 determines that no preceding print medium is found, the processing of the CPU 300 proceeds to S603, where the CPU 300 performs process A, which is described later with reference to FIG. 6. Process A is a process of comparing the communication time of the control data 500 for the preceding (n−1)th sheet for each color with the current time. By performing process A, the CPU 300 determines whether the communication timings of the control data 500 overlap.

Process for Determination of Overlapping of Control Data Communication Timings

Figure 6:
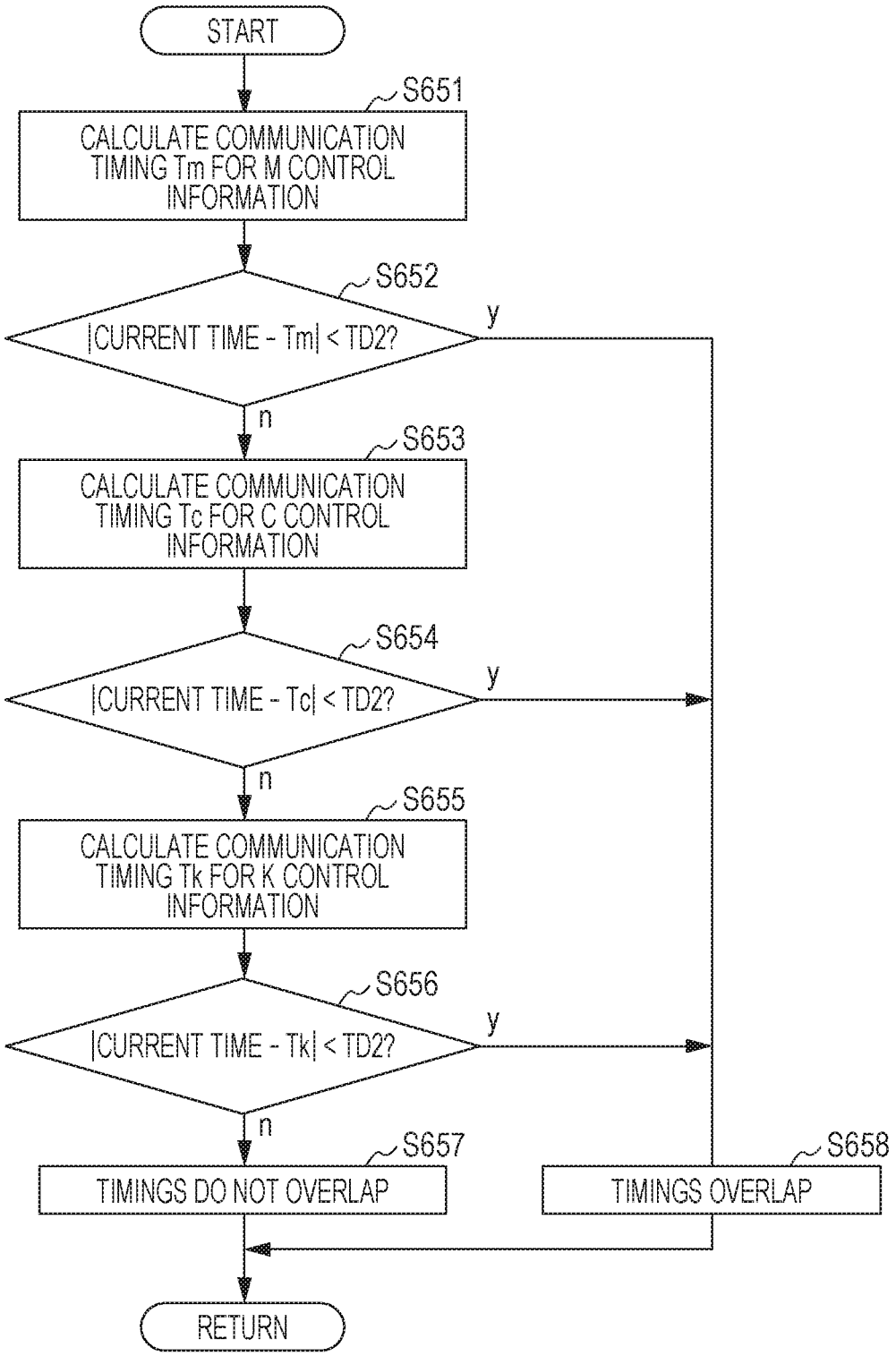
FIG. 6 is a flowchart for determining whether transmission timings of control data overlap according to the exemplary embodiment.

Process A illustrated in FIG. 6 is described below. In S651, the CPU 300 calculates the timing Tm at which communication of the M color control data 500 for the preceding print medium is started (hereinafter, such timing is referred to as "communication timing"). The communication timing Tm is calculated by adding the time period Td1 to the communication time of the Y color control data 500 stored in the RAM 302 for the preceding print medium. The communication time of the Y color control data 500 of the preceding print medium is based on the data stored in the process performed for the preceding print medium in S607 illustrated in FIG. 5. That is, the communication time is the time stored in the RAM 302 at the communication start timing of the Y color control data 500 after the transmission end timing of the Y color image data of the preceding print medium has passed. In S652, the CPU 300 refers to the timer, calculates the absolute value of the difference between the current time and the communication timing Tm for the M color calculated in S651, and determines whether the calculated absolute value is smaller than the predetermined value TD2. Note that the transmission timing of the Y color control data 500 for the current print medium may be earlier or later than the transmission timing of the control data 500 for each color for the preceding print medium. Accordingly, the absolute value of the difference is calculated. If, in S652, the CPU 300 determines that the absolute value of the difference between the current time and the communication timing Tm for M color is smaller than the predetermined value TD2 ($|\text{current time}-Tm|<TD2$), the processing proceeds to S658. In this case, the communication timing Tm of the M color control data 500 for the preceding print medium is close to the communication timing of the Y color control data 500 for the succeeding print medium on which an image is about to be formed. Therefore, in S658, the CPU 300 determines that both timings overlap and, thus, ends process A. Thereafter, the processing returns to the process in FIG. 5. However, if, in S652, the CPU 300 determines that the absolute value of the difference between the current time and the communication timing Tm for M color is larger than or equal to the predetermined value TD2 ($|\text{current time}-Tm|\geq TD2$), the processing proceeds to S653.

In S653, the CPU 300 calculates the communication timing Tc of the C color control data 500 for the preceding print medium. At this time, the communication timing Tc is calculated by adding the time period Td2 to the communication time of the Y color control data 500 stored in the RAM 302 for the preceding print medium. In S654, the CPU 300 refers to the timer and calculates the absolute value of the difference between the current time and the communication timing Tc for C color calculated in S653. Thereafter, the CPU 300 determines whether the calculated absolute value is smaller than the predetermined value TD2. If, in S654, the CPU 300 determines that the absolute value of the difference between the current time and the communication timing Tc for C color is smaller than the predetermined value TD2 ($|\text{current time}-Tc|<TD2$), the processing proceeds to S658. In this case, the communication timing Tc of the C color control data 500 for the preceding print medium is close to the communication timing of the Y color control data 500 for the succeeding print medium on which an image is about to be formed. Therefore, in S658, the CPU 300 determines that the timings overlap and, thus, ends process A. Thereafter, the processing returns to the process in FIG. 5. However, if, in S654, the CPU 300 determines that the absolute value of the difference between the current time and the communication timing Tc for C color is larger than or equal to the predetermined value TD2 (|current time−Tc|≥TD2), the processing proceeds to S655.

In S655, the CPU 300 calculates the communication timing Tk of the K color control data 500 for the preceding print medium. At this time, the communication timing Tk is calculated by adding the time period Td3 to the communication time of the Y color control data 500 stored in the RAM 302 for the preceding print medium. In S656, the CPU refers to the timer and calculates the absolute value of the difference between the current time and the communication timing Tk for K color calculated in S655. Thereafter, the CPU 300 determines whether the calculated absolute value is smaller than the predetermined value TD2. If, in S656, the CPU 300 determines that the absolute value of the difference between the current time and the communication timing Tk for K color is smaller than the predetermined value TD2 (|current time−Tk|<TD2), the processing proceeds to S658. In this case, the communication timing Tk of the K color control data 500 for the preceding print medium is close to the communication timing of the Y color control data 500 for the succeeding print medium on which an image is about to be formed. Therefore, in S658, the CPU 300 determines that the timings overlap and ends process A. Thereafter, the processing returns to the process in FIG. 5. If, in S656, the CPU 300 determines that the absolute value of the difference between the current time and the communication timing Tk for K color is larger than or equal to the predetermined value TD2 (|current time−Tk|≥TD2), the processing proceeds to S657, where the CPU 300 determines that the timings do not overlap and ends process A. Thereafter, the processing returns to the process in FIG. 5. Note that the predetermined value TD2 used in the determination in S652, S654, and S656 is the time required for transmission of the control data 500 and corresponds to a in FIG. 9B.

The CPU 300 determines whether the timings overlap based on the timing of starting transmission of the control data 500 for the (n−1)th sheet, the timing of starting transmission of the control data 500 for the nth sheet, and the time required to transmit the control data 500. In this manner, the CPU 300 functions as a determination unit for determining whether a first timing at which transmission of the Y color control data 500 for the nth sheet starts overlaps the second timing at which the control data 500 for at least one of the colors for the (n−1)th sheet is transmitted.

Referring back to FIG. 5, description of the flowchart continues. In S604, from the result of determination made in S603, the CPU 300 determines whether the communication timing of the control data 500 for the preceding print medium and the communication timing for current print medium overlap. If, in S604, the CPU 300 determines that the timings do not overlap, the processing proceeds to S607. In S607, the CPU 300 stores, in the RAM 302, the current time, which is used for determination in process A for the succeeding print medium, and performs communication of the control data 500. Thereafter, the processing returns to S601.

However, if, in S604, the CPU 300 determines that the timings overlap, the processing proceeds to S605. The CPU 300 starts the timer in order to measure the predetermined time period TD1 in step S605 and refers to the timer in S606. Thus, the CPU 300 determines whether the predetermined time period TD1 has elapsed. The predetermined time period TD1 is a time period set based on a time period for which the time period required for transmitting the Y color control data 500 for the nth sheet and the time period required for transmitting the control data 500 for the color determined to overlap the timing for the (n−1)th sheet (the time period for which α and β overlap in FIG. 9B). That is, the predetermined time period TD1 is a time period calculated based on the first timing, the second timing, and the time period required for transmitting the control data 500. If, in S606, the CPU 300 determines that the predetermined time period TD1 has not elapsed, the processing returns to S606. However, if the CPU 300 determines that the predetermined time period TD1 has elapsed, the processing proceeds to S607. As described above, according to the present exemplary embodiment, if it is determined that the communication start timing of the control data 500 for at least one color overlaps the transmission timing of the control data 500 for the current print medium in process A performed in S603, control is performed as follows. That is, the CPU 300 shifts the communication start timing of the Y color control data 500 by the predetermined time period TD1 (delays the communication start timing by the predetermined time). In addition, the CPU 300 instructs the image processing unit 320 to wait for the predetermined time period TD1 and, thereafter, generate the reference timing signal to be output, which is used as the reference of the timing when image data of each color is transmitted. In S607, the CPU 300 stores the current time in the RAM 302 and performs communication of the control data 500. Thereafter, the processing returns to S601.

As described above, according to the present exemplary embodiment, the CPU 300 stores, in the RAM 302, the time at which communication of the Y color control data 500 is started. Thereafter, when communicating the Y color control data for the succeeding print medium, the CPU 300 calculates the communication time of the control data for each color by using the current time, the communication start time of the Y color control data 500 for the preceding print medium, and the time periods Td1, Td2, and Td3 in Expression (1). Thereafter, the CPU 300 performs comparison. By using the result of comparison among these timings, the CPU 300 determines whether overlapping of the communication timings of the control data 500 occurs. If it is determined that the timings overlap, the CPU 300 delays, by the predetermined time period TD1, the communication timing of the Y color control data 500 for the succeeding print medium and the timing of instructing generation of the reference timing signal used to start transmission of the image data. Note that the predetermined time period TD1 required for serial communication is obtained in advance and is stored in the ROM 301 as a fixed value. In this manner, overlapping of the communication timing of the control data 500 for a print medium and the communication timing of the control data 500 for the preceding print medium for which transmission of image data has already started can be prevented.

As described above, according to the present exemplary embodiment, the CPU 300 determines whether the output timing of the magnification correction data for the first image data and the output timing of the magnification correction data for the second image data overlap. If the output timing of the magnification correction data for the first image data and the output timing of the magnification correction data for the second image data overlap, the CPU 300 performs control as follows. That is, the CPU 300 outputs the magnification correction data for the second image data before the magnification correction data for the first image data is output. After the magnification correction processing performed by the second data processing unit 356 based on the magnification correction data for the nth print medium is completed, the CPU 300 outputs the magnification correction data for the (n+1)th print medium. Note that the first image data is data for forming a first electrostatic latent image for the (n+1)th print medium. The second image data is data for forming an electrostatic latent image for the nth print medium having a size smaller than the (n+1)th print medium in the conveyance direction of the print medium. In addition to the case where the data to be output is magnification correction data, the same applies to the case where the data to be output is, for example, position correction data. Accordingly, description is not repeated.

As described above, according to the present exemplary embodiment, the occurrence of image defects caused by overlapping of transmission timings of control data during continuous printing can be prevented.

Effects

According to an aspect of the embodiments, the occurrence of image defects caused by overlapping of transmission timings of control data during continuous printing can be prevented.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-115453 filed Jun. 9, 2016, which is hereby incorporated by reference herein in its entirety.

What is claimed is:

1. An image forming apparatus comprising:

at least one processor device; and a memory coupled to the at least one processor device, the memory having instructions that, when executed by the processor device, perform operations as:

a first toner image forming unit including a first photoconductor rotatingly driven, a first exposure unit configured to expose the first photoconductor, a first drive unit configured to drive the first exposure unit based on first drive data, and a first development unit configured to develop, with toner of a first color, a first electrostatic latent image formed on the first photoconductor through exposure in the first exposure unit;

a second toner image forming unit including a second photoconductor rotatingly driven, a second exposure unit configured to expose the second photoconductor, a second drive unit configured to drive the second exposure unit based on second drive data, and a second development unit configured to develop, with toner of a second color, a second electrostatic latent image formed on the second photoconductor through exposure in the second exposure unit;

a transfer unit formed as an endless transfer belt rotatingly driven, the transfer unit configured to transfer the toner image on the first photoconductor and the toner image on the second photoconductor to a print medium via the transfer member, a transfer position of the toner image transferred from the first photoconductor to the transfer member being located upstream of a transfer position of the toner image transferred from the second photoconductor to the transfer member in a rotational direction of the transfer member, a formation start timing of the second electrostatic latent image being delayed behind a formation start timing of the first electrostatic latent image on one print medium based on a delay amount in accordance with a distance between the transfer positions;

a first processing integrated circuit configured to generate first image data for the first color and second image data for the second color from input image data;

a second processing integrated circuit configured to generate the first drive data obtained by performing a magnification correction process on the first image data and the second drive data obtained by performing a magnification correction process on the second image data based on set magnification correction data; and a processor configured to switch setting of the magnification correction data in accordance with a size of the print medium, the processor switching the magnification correction data set in the second processing integrated circuit by outputting the magnification correction data for the first image data and the magnification correction data for the second image data at different timings based on the delay amount corresponding to the distance between the transfer positions; and one signal line used both for transmitting the magnification correction data for the first image data from the processor to the second processing integrated circuit and for transmitting the magnification correction data for the second image data from the processor to the second processing integrated circuit, wherein the processor is configured to switch transmitting the magnification correction data for the first image data and the magnification correction data for the second image data via the one signal line, and wherein if a timing of outputting the magnification correction data for the first image data to form the first electrostatic latent image for an (n+1)th print medium overlaps a timing of outputting the magnification correction data for the second image data to form an electrostatic latent image for an nth print medium having a size smaller than the (n+1)th print medium in a conveyance direction of the print medium, the processor outputs the magnification correction data for the second image data to form the second electrostatic latent image for the nth print medium before the magnification correction data for the first image data to form the first electrostatic latent image for the (n+1)th print medium is output, and the processor outputs the magnification correction data for the (n+1)th print medium after a magnification correction process performed by the second processing integrated circuit based on the magnification correction data for the nth print medium is completed.

2. The image forming apparatus according to claim 1, wherein the processor serially transmits, to the second processing integrated circuit, the magnification correction data for the first image data and the magnification correction data for the second image data by using the one signal line.

3. The image forming apparatus according to claim 1, wherein the processor determines whether a timing of outputting the magnification correction data for the first image data to form the first electrostatic latent image for an (n+1)th print medium overlaps a timing of outputting the magnification correction data for the second image data to form an electrostatic latent image for an nth print medium having a size smaller than the (n+1)th print medium in a conveyance direction of the print medium.

4. The image forming apparatus according to claim 1, wherein the first processing integrated circuit and the second processing integrated circuit are integrated circuits mounted on different circuit boards, and the one signal line is connected to the circuit board having the first processing integrated circuit mounted thereon and the circuit board having the second processing integrated circuit mounted thereon.

5. The image forming apparatus according to claim 4, wherein the processor is mounted on the circuit board having the first processing integrated circuit mounted thereon, and transmission of control data from the processor to the first processing integrated circuit is electrically performed through a printed wire formed on each of the circuit board having the first processing integrated circuit mounted thereon and the circuit board having the processor mounted thereon.

6. The image forming apparatus according to claim 1, wherein the processor transmits control data other than the magnification correction data to the second processing integrated circuit via the one signal line.

* * * * *